US009589775B2

(12) United States Patent
Perelman et al.

(10) Patent No.: US 9,589,775 B2
(45) Date of Patent: Mar. 7, 2017

(54) PLASMA CLEANING FOR MASS SPECTROMETERS

(71) Applicant: Agilent Technologies, Inc., Santa Clara, CA (US)

(72) Inventors: Gershon Perelman, Cupertino, CA (US); Mark Denning, San Jose, CA (US); Mehrnoosh Vahidpour, Santa Clara, CA (US); Guthrie Partridge, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/814,147

(22) Filed: Jul. 30, 2015

(65) Prior Publication Data

US 2016/0035550 A1 Feb. 4, 2016

Related U.S. Application Data

(60) Provisional application No. 62/032,260, filed on Aug. 1, 2014.

(51) Int. Cl.
*H01J 49/26* (2006.01)
*H01J 49/00* (2006.01)

(52) U.S. Cl.
CPC ..... *H01J 49/00* (2013.01)

(58) Field of Classification Search
CPC ..... H01J 49/10; H01J 49/26
USPC ..... 250/281, 282
See application file for complete search history.

(56) References Cited

U.S. PATENT DOCUMENTS

| | | | | |
|---|---|---|---|---|
| 5,539,211 | A | 7/1996 | Ohtoshi et al. | |
| 6,105,589 | A | 8/2000 | Vane | |
| 8,378,293 | B1 | 2/2013 | Quimby et al. | |
| 2005/0103266 | A1 | 5/2005 | Chandran et al. | |
| 2009/0014644 | A1* | 1/2009 | Yang | H01J 49/145 250/288 |
| 2009/0032728 | A1 | 2/2009 | Divergilio et al. | |
| 2009/0200457 | A1 | 8/2009 | Holle et al. | |
| 2010/0154835 | A1 | 6/2010 | Dimeo et al. | |
| 2013/0276820 | A1 | 10/2013 | Cigal et al. | |
| 2014/0320012 | A1* | 10/2014 | Bassom | H01J 37/32853 315/111.21 |

OTHER PUBLICATIONS

International Search Report and Written Opinion dated Nov. 27, 2015 from related International Application No. PCT/US2015/042950.

Vincent S. Smentkowski & C.A. Moore, In-situ plasma cleaning of samples to remove hydrocarbon and/or polydimethylsiloxane prior to ToF-SIMS analysis, (Journal of Vacuum Science and Technology A 31(6) Nov./Dec. 2013.).

Lydia-Marie Joubert, High-resolution imaging with field-emission SEM: the need for downstream plasma cleaning in biological applications.

* cited by examiner

*Primary Examiner* — Nicole Ippolito

(57) ABSTRACT

A mass spectrometry (MS) system may be cleaned by generating plasma and contacting an internal surface of the system to be cleaned with the plasma. The system may be switched between operating in an analytical mode and in a cleaning mode. In the analytical mode a sample is analyzed, and plasma may or may not be actively generated. In the cleaning mode the plasma is actively generated, and the sample may or may not be analyzed.

17 Claims, 8 Drawing Sheets

PLASMA CLEANING FOR MASS SPECTROMETERS

RELATED APPLICATIONS

This application claims the benefit of U.S. Provisional Patent Application Ser. No. 62/032,260, filed Aug. 1, 2014, titled "PLASMA CLEANING FOR MASS SPECTROMETERS," the content of which is incorporated by reference herein in its entirety.

TECHNICAL FIELD

The present invention relates to cleaning interior surfaces of mass spectrometers by utilizing plasma or one or more species thereof as the cleaning agent.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios.

In the serial process flow through the internal chambers of these devices, ions and gas molecules encounter various internal surfaces and pass through various ion optics components. Over time as the surfaces continue to be exposed to the flow of the ions and gas molecules, including surfaces of the ion optics components, layers of residual material may be deposited on these surfaces. Such layers can be electrically insulating, and may further be dielectric. Consequently, the outermost surface of the deposited layers can build up electrical charge from the charge of the ions deposited on its surface. As this electrical charge increases so does the potential (voltage) to the point that it can disrupt the nominal electric field of the affected component and cause a reduction in the transmission of the ions through the component. The contamination can lead to a degradation in the ion signal utilized to produce mass spectra, such as a decrease in signal intensity and resolution. The reduction in the signal is time dependent and can progress to the point that the entire signal is blocked. In some cases, the contamination problem has been observed to result from ionizing organic molecules such as certain types of analytes (e.g., proteins), background matrix materials such as solvents, and oil molecules from the vacuum pumps. The accumulation of such contaminants on surface is thus highly undesirable.

The conventional approach to cleaning a contaminated surface requires that the contaminated surface be removed from the MS system and cleaned externally. This requires shutting down operation of the system and venting the system to break vacuum, then opening or disassembling some part of the system to access the component containing the contaminated surface, and removing the component from the system. Removal of the component often requires disassembly of features utilized for mounting and setting the optical alignment of the component. Once removed, the contaminated surface is cleaned using an abrasive or solvent as needed, and then re-installed in the system with proper mounting and alignment. Then the system must be pumped back down to the vacuum levels required for operation, and re-tuned as needed to accommodate the newly cleaned surface. Thereafter, the system must be re-tuned as necessary for accommodating a new building up of contaminants on the surface, until such time as it is necessary to shut down the system again and repeat the cleaning procedure. The conventional cleaning approach thus results in significant loss of operating time, mechanical wear and fatigue on components, the use of hazardous compounds such as cleaning solvents, and the potential for exposing users to hazardous compounds.

Therefore, there is a need for MS systems and methods capable of cleaning internal surfaces. In particular, there is a need for MS systems and methods capable of cleaning internal surfaces in situ.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for operating a mass spectrometry (MS) system includes: operating the MS system in an analytical mode by introducing a sample into the MS system, producing analyte ions from the sample, and producing analytical data from the analyte ions; switching between operating the MS system in the analytical mode and a cleaning mode; and during the cleaning mode: generating plasma by operating a plasma source of the MS system; and contacting an internal surface of the MS system with the plasma to clean the internal surface.

According to another embodiment, a mass spectrometry (MS) system is configured for performing any of the methods disclosed herein.

According to another embodiment, the MS system includes: an ion source configured for producing the analyte ions; a chamber in which the internal surface is located; and a controller configured for switching between operating the MS system in the analytical mode and a cleaning mode. The plasma source is configured for generating or flowing plasma in the chamber.

According to another embodiment, a mass spectrometry (MS) system includes: an ion source configured for producing analyte ions; a chamber; an internal surface located in the chamber; a plasma source configured for generating or flowing plasma in the chamber effective for cleaning the internal surface; and a controller configured for switching between operating the MS system in an analytical mode and a cleaning mode, wherein: during the analytical mode, the controller is configured for producing analytical data from the ion measurement signals; and during the cleaning mode the controller is configured for operating the plasma source to generate or flow the plasma in the chamber.

The MS system may include a mass analyzer configured for receiving analyte ions from the ion source. The MS system may include an ion detector configured for receiving analyte ions from the mass analyzer and outputting ion measurement signals.

In some embodiments, the chamber may be a chamber located at the ion source, a chamber located at a mass analyzer, a chamber located at an ion detector, or a chamber located between the ion source and a mass analyzer or between the ion source and an ion detector.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
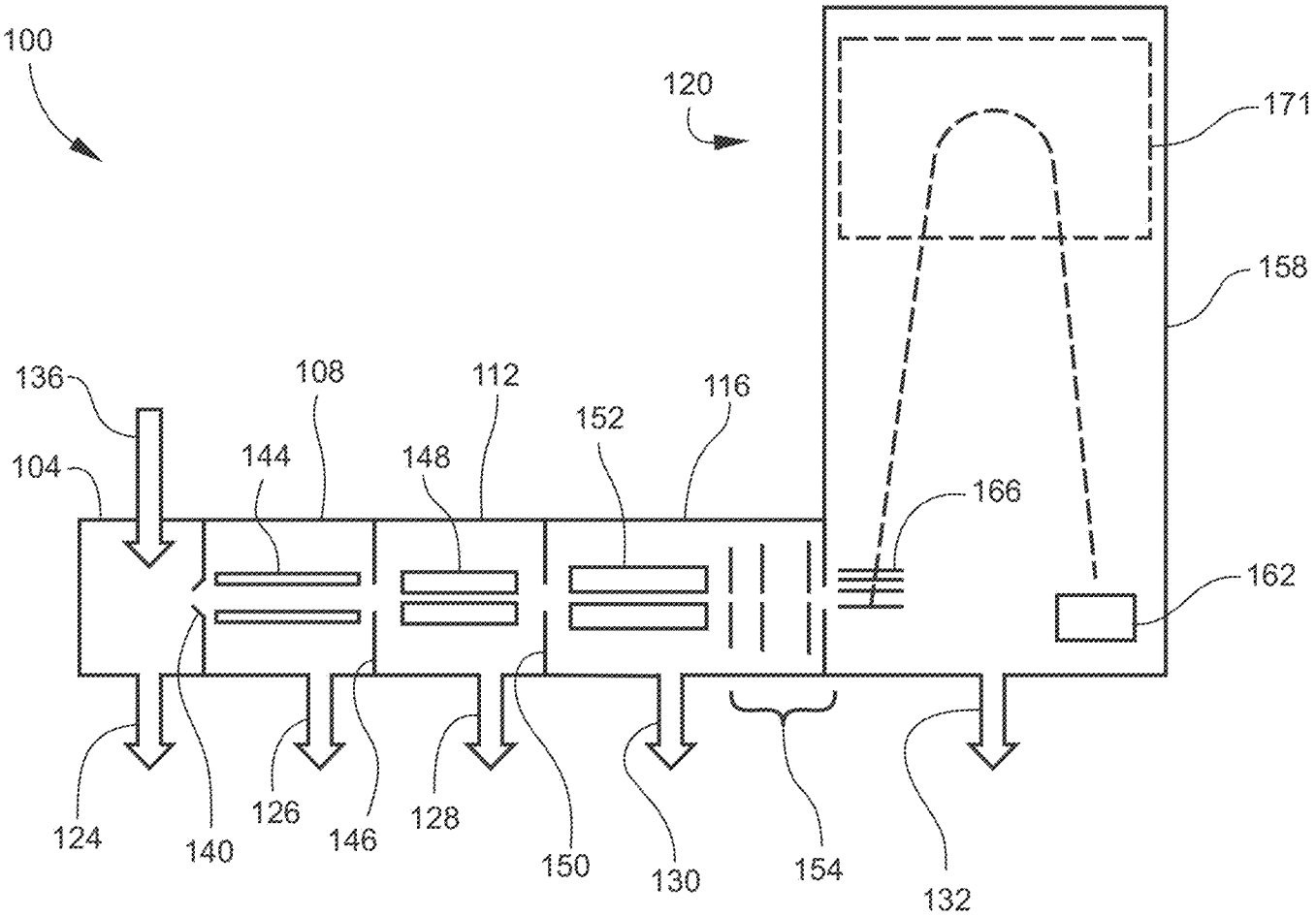
FIG. 1A is a schematic view of an example of a mass spectrometry (MS) system according to some embodiments.

FIG. 1A is a schematic view of an example of a mass spectrometry (MS) system 100 according to some embodiments. The operation and design of various components of mass spectrometry systems are generally known to persons skilled in the art and thus need not be described in detail herein. Instead, certain components are briefly described to facilitate an understanding of the subject matter presently disclosed.

The MS system 100 may generally include an ion source 104, one or more ion transfer devices 108, 112, and 116 (or ion processing devices), and a mass spectrometer (MS) 120. Three ion transfer devices 108, 112, and 116 are illustrated by example only, as other embodiments may include more than three, less than three, or none. The MS system 100 includes a plurality of chambers arranged in series such that each chamber communicates with at least one adjacent (upstream or downstream) chamber. Each of the ion source 104, ion transfer devices 108, 112, and 116, and MS 120 includes at least one of these chambers. Thus, the MS system 100 defines a flow path for ions and gas molecules generally from the chamber of the ion source 104, through the chambers of the ion transfer devices 108, 112, and 116, and into the chamber of the MS 120. From the perspective of FIG. 1A, the flow path is generally directed from the left to the right. Each chamber is physically separated from an adjacent chamber by at least one structural boundary, e.g., a wall. The wall includes at least one opening to accommodate the flow path. The wall opening may be quite small relative to the overall dimensions of the chambers, thus serving as a gas conductance barrier that limits transfer of gas from a preceding chamber to a succeeding chamber and facilitates independent control of respective vacuum levels in adjacent chambers. The wall may serve as an electrode or ion optics component. Alternatively or additionally, electrodes and/or ion optics components may be mounted to or positioned proximate to the wall. Any of the chambers may include one or more ion guides, such as a linear multipole ion guide (e.g., quadrupole, hexapole, octopole, etc.) or an ion funnel.

At least some of the chambers may be considered to be pressure-reducing chambers, or vacuum stages, that operate at controlled, sub-atmospheric internal gas pressures. For this purpose the MS system 100 includes a vacuum system communicating with vacuum ports of such chambers. In the illustrated embodiment, each of the ion source 104, ion transfer devices 108, 112, and 116, and MS 120 includes at least one chamber having a respective vacuum port 124, 126, 128, 130, and 132 that communicates with a vacuum system. Generally, when the MS system 100 is operated to analyze a sample (the "analytical" mode, described below), each chamber successively reduces the gas pressure below the level of the preceding chamber, ultimately down to the very low vacuum-level required for operating the MS 120 in the analytical mode (e.g., ranging from $10^{-4}$ to $10^{-9}$ Torr).

In FIG. 1A, the vacuum ports 124, 126, 128, 130, and 132 are schematically represented by wide arrows. The vacuum system as a whole is schematically represented by these wide arrows, with the understanding that the vacuum system includes vacuum lines leading from the vacuum ports 124, 126, 128, 130, and 132 to one or more vacuum-generating pumps and associated plumbing and other components as appreciated by persons skilled in the art. As described further below, the MS system 100 disclosed herein may be operative in an analytical mode and a cleaning mode. In the analytical mode, one or more of the vacuum ports 124, 126, 128, 130, and 132 may remove non-analyte neutral molecules from the ion path through the MS system 100. In the cleaning mode, one or more of the vacuum ports 124, 126, 128, 130, and 132 may remove plasma, gas utilized to form plasma, and contaminants removed from internal surfaces of the MS system 100 through application of the plasma. The pressures on the different vacuum ports 124, 126, 128, 130, and 132 may be adjusted to ensure a flow of the plasma gases in the desired direction. In some embodiments, the analytical mode and the cleaning mode may be implemented separately as distinct modes of operation. For example, the MS system 100 may be switched, automatically or on demand, between the analytical mode and the cleaning mode. In other embodiments, the analytical mode and the cleaning mode may be implemented in tandem (simultaneously).

The ion source 104 may be any type of continuous-beam or pulsed ion source suitable for producing analyte ions for mass spectral analysis. Examples of ion sources 104 include, but are not limited to, electrospray ionization (ESI) sources, photo-ionization (PI) sources, electron ionization (EI) sources, chemical ionization (CI) sources, field ionization (FI) sources, plasma or corona discharge sources, laser desorption ionization (LDI) sources, and matrix-assisted laser desorption ionization (MALDI) sources. Some of the examples just noted are, or may optionally be, atmospheric pressure ionization (API) sources in that they operate exclusively at or near atmospheric pressure such as ESI sources, or may be configured to do so such as atmospheric pressure photo-ionization (APPI) sources and atmospheric pressure chemical ionization (APCI) sources. An API source nonetheless includes a vacuum port 124 (exhaust port) by which gas, contaminants, etc. may be removed from the chamber. The chamber of the ion source 104 is an ionization chamber in which sample molecules are broken down to analyte ions by an ionization device (not shown). The sample to be ionized may be introduced to the ion source 104 by any suitable means, including hyphenated techniques in which the sample is an output 136 of an analytical separation instrument such as, for example, a gas chromatography (GC) or liquid chromatography (LC) instrument (not shown). The ion source 104 may include a skimmer 140 (or two or more skimmers axially spaced from each other), also referred to as a skimmer plate, skimmer cone, or sampling cone. The skimmer 140 has a central aperture. The skimmer 140 is configured for preferentially allowing ions to pass through to the next chamber while blocking non-analyte components. The ion source 104 may also include other components (electrodes, ion optics, etc., not shown) useful for organizing as-produced ions into a beam that may be efficiently transferred into the next chamber.

In some embodiments, the first ion transfer device 108 may be configured primarily as a pressure-reducing stage. For this purpose, the ion transfer device 108 may include ion transfer optics 144 configured for keeping the ion beam focused along a main optical axis of the MS system 100. The ion transfer optics 144 may have various configurations known to persons skilled in the art, such as, for example, a multipole arrangement of electrodes elongated along the axis (e.g., a multipole ion guide), a serial arrangement of ring electrodes, an ion funnel, a split cylinder electrode, etc. In some embodiments, the ion transfer optics 144 may be configured as an ion trap. One or more lenses 146 may be positioned between the ion transfer device 108 and the adjacent ion transfer device 112.

In some embodiments, the second ion transfer device 112 may be configured as a mass filter or an ion trap configured for selecting ions of a specific m/z ratio or m/z ratio range. For this purpose, the ion transfer device 108 may include ion transfer optics 148 such as a multipole arrangement of electrodes (e.g., a quadrupole mass filter). One or more lenses 150 may be positioned between the ion transfer device 112 and the adjacent ion transfer device 116. In other embodiments, the ion transfer device 112 may be configured primarily as a pressure-reducing stage.

In some embodiments, the third ion transfer device 116 may be configured as a cooling cell. For this purpose, the ion transfer device 116 may include ion transfer optics 152 such as a multipole arrangement of electrodes, configured as a non-mass-resolving, RF-only device. A cooling gas (or damping gas) such as, for example, argon, nitrogen, helium, etc., may be flowed into the chamber of the ion transfer device 116 to cool down (or "thermalize," i.e., reduce the kinetic energy of) the ions during operation in the analytical mode by way of collisions between the ions and the gas molecules. In other embodiments, the ion transfer device 116 may be configured as an ion fragmentation device such as a collision cell. In one example, ion fragmentation is accomplished by way of collision induced dissociation (CID), in which case the gas added to the chamber (the "collision gas") results in a gas pressure sufficient to enable fragmentation by CID. Ion beam shaping optics 154 may be positioned between the ion transfer device 116 and the MS 120. In other embodiments, the ion transfer device 116 may be configured primarily as a pressure-reducing stage.

The MS 120 may be any type of MS. The MS 120 generally includes a mass analyzer 158 and an ion detector 162. In the illustrated embodiment, by example only, the MS 120 is depicted as a time-of-flight mass spectrometer (TOFMS). In this case, the mass analyzer 158 includes an evacuated, electric field-free flight tube into which ions are injected by an ion pulser 166 (or ion pusher, ion puller, ion extractor, etc.). As appreciated by persons skilled in the art, the beam shaping optics 154 direct the ion beam into the ion pulser 166, which pulses the ions into the flight tube as ion packets. The ions drift through the flight tube toward the ion detector 162. Ions of different masses travel through the flight tube at different velocities and thus have different overall times-of-flight, i.e., ions of smaller masses travel faster than ions of larger masses. Each ion packet spreads out (is dispersed) in space in accordance with the time-of-flight distribution. The ion detector 162 detects and records the time that each ion arrives at (impacts) the ion detector 162. A data acquisition device then correlates the recorded times-of-flight with m/z ratios. The ion detector 162 may be any device configured for collecting and measuring the flux (or current) of mass-discriminated ions outputted from the mass analyzer 158. Examples of ion detectors include, but are not limited to, multi-channel plates, electron multipliers, photomultipliers, and Faraday cups. In some embodiments, as illustrated, the ion pulser 166 accelerates the ion packets into the flight tube in a direction orthogonal to the direction along which the beam shaping optics 154 transmit the ions into the ion pulser 166, which is known as orthogonal acceleration TOF (oa-TOF). In this case, the flight tube often includes an ion mirror (or reflectron) 171 to provide a 180° reflection or turn in the ion flight path for extending the flight path and correcting the kinetic energy distribution of the ions. In other embodiments, the MS 120 may include another type of mass analyzer such as, for example, a mass filter, an ion trap, an ion cyclotron resonance (ICR) cell, an electrostatic ion trap, or a static electric and/or magnetic sector analyzer.

In operation in the analytical mode, a sample is introduced to the ion source 104. The ion source 104 produces sample ions (analyte ions and background ions) from the sample and transfers the ions to one or more ion transfer devices 108, 112, and 116. The ion transfer device(s) 108, 112, and 116 transfer the ions through one or more pressure-reducing stages and into the MS 120. Depending on what type or types of ion transfer devices 108, 112, and 116 are included, the ion transfer device(s) 108, 112, and 116 may perform additional ion processing operations such as mass filtering, ion fragmentation, beam shaping, etc., as described above. The MS 120 mass-resolves the ions as described above. The measurement signals outputted from the ion detector 162 are processed by electronics of the MS system 100 to produce mass spectra.

The MS system 100 includes a number of internal surfaces located in the ion/gas path of the MS system 100. These internal surfaces may become fouled as a result of operation in the analytical mode. That is, contaminants (e.g., layers or films of contaminant material) may be deposited on the internal surfaces and accumulate over time. The source of the contaminant may be the analyte components and/or background components of the sample under analysis. In cases where, for example, the sample includes a heavy hydrocarbon (e.g., oil) or high molecular weight organic compound (e.g., protein), the contaminant that gets deposited may be elemental carbon or an organic compound. Internal surfaces that may become fouled include, for example, ion optics components, electrodes, skimmers, gas conductance barriers, the outer surfaces of ion detectors, the walls (inside surfaces) of the chambers, and the grids on the ion pulser and reflectron (ion mirror). Specific examples shown in FIG. 1A may include the skimmer 140, ion optics or electrodes 144, 148, and 156, lenses 146 and 150, beam shaping optics 154, and ion detector 162, as well as the inside surfaces of walls of the various chambers.

In various embodiments, the MS system 100 includes an integral plasma cleaning system configured for cleaning one or more of the internal surfaces by in situ plasma treatment. The plasma cleaning system may include a plasma source configured for generating plasma directly in a chamber of the MS system 100, or generating plasma outside the chamber and flowing the plasma into the chamber via a plasma port. The plasma source may include a plurality of individual plasma sources, and/or a plurality of individual plasma ports, positioned at different locations of the MS system 100 whereby plasma is generated or distributed at different locations of the MS system 100. In some embodiments the MS system 100 may be configured, along with the positions of the plasma sources and/or plasma ports relative to the internal surfaces to be cleaned and relative to the vacuum ports, so as to define one or more plasma flow paths that run from one or more plasma sources or plasma ports, through one or more chambers, and into one or more vacuum ports. One or more internal surfaces are positioned in each plasma flow path (or plasma diffusion path). That is, one or more internal surfaces are located relative to the plasma flow such that the plasma contacts the internal surface(s), or stated differently the internal surface(s) are exposed to the plasma. When the plasma comes into contact with an internal surface, the plasma may remove contaminants from the internal surface by reaction between the contaminants and one or more types of active species of the plasma. Contaminants so removed may then be entrained in the plasma/gas flow. The plasma, plasma-forming gas, and removed contaminants may be removed from the MS system 100 by flowing them into one or more vacuum ports. In the present context, the term "contaminants" includes derivatives of the contaminants, i.e., products of reactions between the contaminants and the plasma. As one non-limiting example, an air plasma or oxygen plasma may be utilized to remove organic deposits by reducing them to water, carbon monoxide (CO), and/or carbon dioxide ($CO_2$).

No specific limitation is placed on the type of plasma utilized or its composition. The plasma may be powered (ignited and sustained) by radio frequency (RF) energy, RF-powered microwave energy, alternating current (AC) energy, or direct current (DC) energy. The plasma-forming gas, i.e., the gas energized into plasma, may be ambient air. Other examples of the plasma-forming gas include, but are not limited to, an oxygen-containing gas, diatomic oxygen gas ($O_2$), a hydrogen-containing gas, diatomic hydrogen gas ($H_2$), helium-containing gas, helium (He), other noble gases such as argon (Ar), and combinations of two or more of the foregoing. Additional examples include halogen-containing gases such as fluorine-containing compounds. In the present context, the term plasma-forming "gas" encompasses a single type of gas or a mixture of two or more types of gas, unless specified otherwise or the context dictates otherwise. Generally, the active (or reactive) species of the plasma that may contribute to contaminant removal may include, for example, free radicals, molecular fragments, monomers, atomic species, ozone, metastables, molecular ions, plasma ions (as distinguished from sample ions produced in the ion source 104 during the analytical mode described above), electrons, and photons. As one example, the reactive species of an air plasma or oxygen plasma may include oxygen atoms (O), oxygen ions ($O^{-2}$), metastable oxygen molecules ($O_2$*), and ozone ($O_3$). Other examples include ions, molecular ions, and metastable and radical forms of helium and hydrogen. The plasma may be applied to a surface as a non-thermal (non-equilibrium) plasma in which the mechanism of contaminant removal is solely or predominantly one or more types of chemical reaction.

In some embodiments, one or more reactive species (e.g., residual radicals, molecular fragments, ozone, ions, etc.) produced by the plasma may be effective as a cleaning agent even after the plasma has been fully or partially extinguished during the course of flowing through a chamber. Thus, for convenience the term "plasma" encompasses electrically active (energized) plasma, afterglow plasma, and fully or partially extinguished plasma/plasma gas, unless specified otherwise or the context dictates otherwise.

It will be noted that certain ion sources are configured to generate plasma utilized to ionize the sample in preparation for mass analysis through a mechanism such as electron impact, charge exchange with plasma ions, and/or photoionization via ultraviolet (UV) photons. In some embodiments, the ion source 104 of the MS system 100 may be a plasma-based ion source. In such embodiments, the ion source 104 may be separate and distinct from the plasma source(s) provided by the plasma cleaning system, or may be the direct source of the plasma utilized for cleaning purposes as well as for producing analyte ions from sample material. As a further alternative, both the ion source 104 (if plasma-based) and one or more additional or auxiliary plasma sources may be utilized as plasma sources.

Figure 1B:
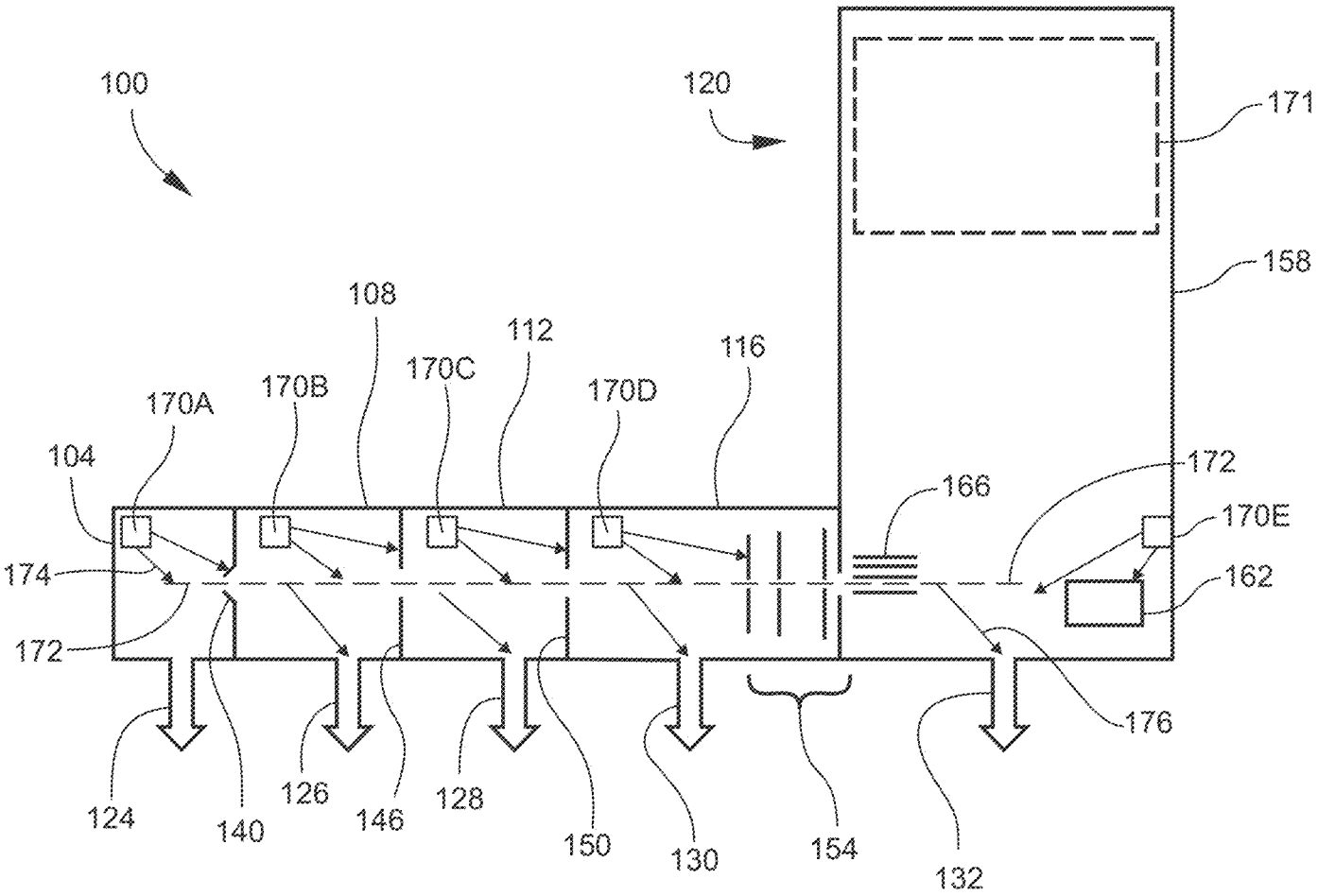
FIG. 1B is a schematic view of MS system, illustrating components of a plasma cleaning system and a plasma flow path defined or established by the MS system, according to some embodiments.

FIG. 1B is a schematic view of the MS system 100, illustrating components of the plasma cleaning system provided by the MS system 100, and a plasma flow path defined or established by the MS system 100, according to some embodiments. In some embodiments, the plasma cleaning system is operated during a cleaning mode of the MS system 100, which may be alternated with the analytical mode as described herein. In some embodiments, the plasma cleaning system is operated during the analytical mode, i.e., the MS system 100 is configured such that the analytical mode is a self-cleaning mode or is carried out in tandem with the cleaning mode as described herein.

Depending on the number of plasma sources provided and their locations, the plasma flow path may extend through one or more chambers of the MS system 100 and thus may contact one or more internal surfaces desired to be cleaned. In the illustrated embodiment, the MS system 100 includes a plurality of plasma sources 170A, 170B, 170C, 170D, and 170E located at respective chambers of the ion source 104, the ion transfer devices 108, 112, and 116, and the MS 120.

Each plasma source 170A, 170B, 170C, 170D, and 170E includes a plasma-generating element, i.e., a component that transfers energy to the plasma-forming gas to ignite and sustain the plasma. In some embodiments the plasma-generating element is located in the chamber. In this case, the internal plasma-generating element may be positioned very close to an internal surface to be cleaned to maximize the probability of exposure to and reaction with the plasma. Such a configuration may be particularly useful in a case where the internal surface to be cleaned is at a location not favorable to gas flow in the chamber. For example, the plasma-generating element could be a pair of electrodes, a resonator, or an antenna strategically positioned relative to the internal surface to be cleaned. In some embodiments, one or more of the plasma sources 170A, 170B, 170C, 170D, and 170E may include a plasma source housing (or plasma containment box) in which the plasma is generated, and a plasma port through which the as-generated plasma flows into the chamber. In such case, the plasma-generating element may be located near, on, or in the chamber, depending on design and how the energy provided by the plasma-generating element is coupled into the plasma-forming gas. Depending on the embodiment, the plasma source housing may be located in the chamber or outside the chamber. In embodiments providing a plasma source housing, whether internal or external to the chamber, the plasma port may be positioned very close to internal surface to be cleaned if desired. Moreover, in embodiments providing an internal or external plasma source housing, the plasma may be generated in the housing at a pressure different from the pressure of the chamber. For example, the plasma may be generated in the housing at or near atmospheric pressure while the chamber is held at a lower pressure such as a vacuum level. In some embodiments, as an alternative to locating a plasma-generating element or plasma port proximate to a particular internal surface, the plasma-generating element or plasma port may be located relatively far from a given vacuum port 124, 126, 128, 130, and 132 to ensure a flow of plasma across a multitude of internal surfaces to be cleaned before being removed by the vacuum system.

In the illustrated embodiment, the plasma flow path generally runs in the downstream direction of the MS system 100, from left to right from the perspective of FIG. 1B. The main portion of the plasma flow path is indicated by a dashed line 172 extending through the chambers. The plasma flow path may include a plurality of entrance paths (e.g., 174) directed out from the plasma-generating elements (and plasma ports, if provided) of the respective plasma sources 170A, 170B, 170C, 170D, and 170E toward respective internal surfaces, and a plurality of exit paths (e.g., 176) directed into respective vacuum ports 124, 126, 128, 130, and 132. The plasma-generating elements (if internal) or plasma ports (if provided) of the plasma sources 170A, 170B, 170C, 170D, and 170E may be positioned in the chambers at a distance and orientation relative to internal surfaces in a manner that places the internal surfaces in the plasma flow path to ensure exposure to and interaction with the plasma. In some embodiments, the positions and/or orientations of the plasma-generating elements or plasma ports may be adjustable so as to enable adjustment of the distance and/or angle between the plasma-generating elements or plasma ports and selected internal surfaces. In some embodiments, one or more of the chambers may include two or more plasma ports. In some embodiments, plasma-generating elements or plasma ports may not be included in certain chambers, such as chambers in which contamination is of lesser concern or chambers for which plasma-based cleaning is not desired.

In some embodiments, the MS system 100 includes at least a first (upstream) chamber and a second (downstream) chamber downstream from the first chamber. The internal surface to be cleaned is located in the second chamber, and at least a portion of the plasma source (e.g., plasma-generating element and/or plasma port) is located in the first chamber or the second chamber. In some embodiments, the vacuum port into which the plasma flow path exits is located in the second chamber. In other embodiments, the MS system 100 includes at least a third chamber downstream from the second chamber, and the vacuum port is located in the third chamber.

In some embodiments, the MS system 100 includes a plurality of chambers arranged in series such that each chamber communicates with at least one adjacent chamber, and further includes a plurality of internal surfaces to be cleaned. Two or more of the chambers contain at least one of the internal surfaces. The MS system 100 establishes respective vacuum-level gas pressures in the chambers so as to achieve a desired plasma flow path to which one or more internal surfaces to be cleaned are exposed. Two or more of the chambers may include at least one of the vacuum ports. The plasma flow path may include a plurality of exit paths respectively leading into two or more of the vacuum ports. The MS system 100 may include a plurality of plasma-generating elements and/or plasma ports respectively located in two or more of the chambers, and the plasma flow path may include a plurality of entrance paths leading out from the respective plasma-generating elements and/or plasma ports.

The plasma flow path may be modified as desired to select certain internal surfaces to be cleaned. For example, the plasma flow path may be modified by selecting which plasma sources 170A, 170B, 170C, 170D, and 170E are active and/or which vacuum ports 124, 126, 128, 130, and 132 are active. Additionally or alternatively, the plasma flow path may be modified by setting the respective vacuum levels at the vacuum ports 124, 126, 128, 130, and 132 as desired. In some embodiments, the vacuum-level gas pressure in a given chamber during the cleaning mode is a higher pressure than the vacuum-level gas pressure in that same chamber during the analytical mode. For example, the vacuum-level gas pressure during the cleaning mode may be one or more orders of magnitude higher than during the analytical mode. In some embodiments, the vacuum-level gas pressure during the cleaning mode is on the order of milliTorrs (mTorr).

In further alternative or additional embodiments, the plasma flow path may be modified by magnets and/or biased electrodes strategically located relative to one or more of the plasma sources 170A, 170B, 170C, 170D, and 170E and the internal surface(s) to be cleaned, whereby the charged species of the plasma flux (plasma ions and electrons) are guided by the magnetic and/or electric fields applied. Non-charged energetic species (e.g. metastable atoms, photons, neutral free radicals) will not be guided by these fields but can diffuse to or illuminate a target surface if they are created within the plasma at a location that makes this possible (e.g., plasma proximate to the target surface, and/or entrained in a gas flow path directed toward the target surface).

Magnets utilized for guiding plasma flux may be electromagnets or permanent magnets. Typically, such magnets are positioned outside the chamber. Permanent magnets may be mechanically repositionable if the magnetic field needs to be removed so as not to interfere with an analytical-mode operation in a particular chamber. In some embodiments, magnetic fields may be utilized to create plasma by microwave-powered electron cyclotron resonance (ECR) excitation, described below.

In embodiments utilizing electrodes to apply one or more electric fields for guiding plasma flux, the electrodes may be electrodes serving a role in the analytical operation of the MS system 100, such as controlling the analyte ion beam (e.g., lens components, ion deflectors, multipole ion guide electrodes, etc.) or ionizing the analyte compounds (e.g., electrodes controlling the electron beam of an EI source).

Such electrodes themselves may have outer surfaces that need to be cleaned, and hence may be appropriately biased to attract the plasma ions and/or electrons. Applying an electric potential to such an electrode in the presence of a plasma can accelerate the charged particle species, typically plasma ions, onto the surface of the electrode. This addition of kinetic energy can enhance the cleaning process by charged particle (particularly ion) bombardment. In normal operations, surfaces within existing MS instruments that are most prone to contamination (including ion lenses used for extraction of ions from the ionization region and slicer optics used for beam shaping) are biased with voltages for the purpose of creating and shaping ion beams. The same electronics can be used in different modes of operation: to perform ion guiding in an analytical mode, and accelerate charged plasma particles during an offline cleaning mode. In addition or alternative to electrodes operated for ion control, other electrodes (i.e., auxiliary or supplemental electrodes) may be added to the system to serve the dedicated role of modifying the plasma flow path.

As noted above, one or more of the ion transfer devices 108, 112, and 116 may include a set of multipole rod electrodes (quadrupoles, hexapoles, octopoles, etc.) configured for ion guiding or both guiding and selection of ions with particular mass-to-charge ratios for analysis. Over time these multipole rod electrodes can become coated with contaminants, for example ions whose trajectories through a quadrupole caused them to impinge on the rod electrodes. These electrodes are typically operated in the RF regime (approximately 1 MHz). Electric fields in this frequency domain can also be used to accelerate ions present in a plasma so that they impact surfaces with high kinetic energies. Plasma produced by a plasma source as described herein may be introduced into a multipole device and the ions within that plasma accelerated onto the surfaces of the rod electrodes by the same RF field used in normal operation, in order to clean the surfaces. The parameters of the RF field (or composite RF/DC field) may be adjusted as needed for optimizing the analytical mode (e.g., guiding analyte ions in stable trajectories without impacting the electrodes) and the cleaning mode (accelerating plasma ions into contact with the electrodes). Other ion optics could be similarly biased with RF or RF/DC fields.

In a plasma-based ionization source, the bias voltage may have a pulsed waveform with two different voltage levels. A higher-voltage bias may be applied to accelerate background plasma ions onto the biased surfaces, and during the remainder of the pulsed waveform period a lower-voltage bias may be applied at the desired value for ion beam guiding. In this way the electrode surface may be continuously cleaned during operation. Such voltage pulses may induce collisional ionization/fragmentation that affect the measured mass spectrum, such that this technique may not be desirable in all situations. Additional ion optics may be employed to reject ions created during the high-voltage part of the waveform by pulsing the voltage on these optics in sync. If the undesired analyte ion bunches arrive at the detector without having been mixed with desired analyte ions in the beam through dispersion, such ions may be rejected from measured mass spectra by data post-processing.

Figure 2:
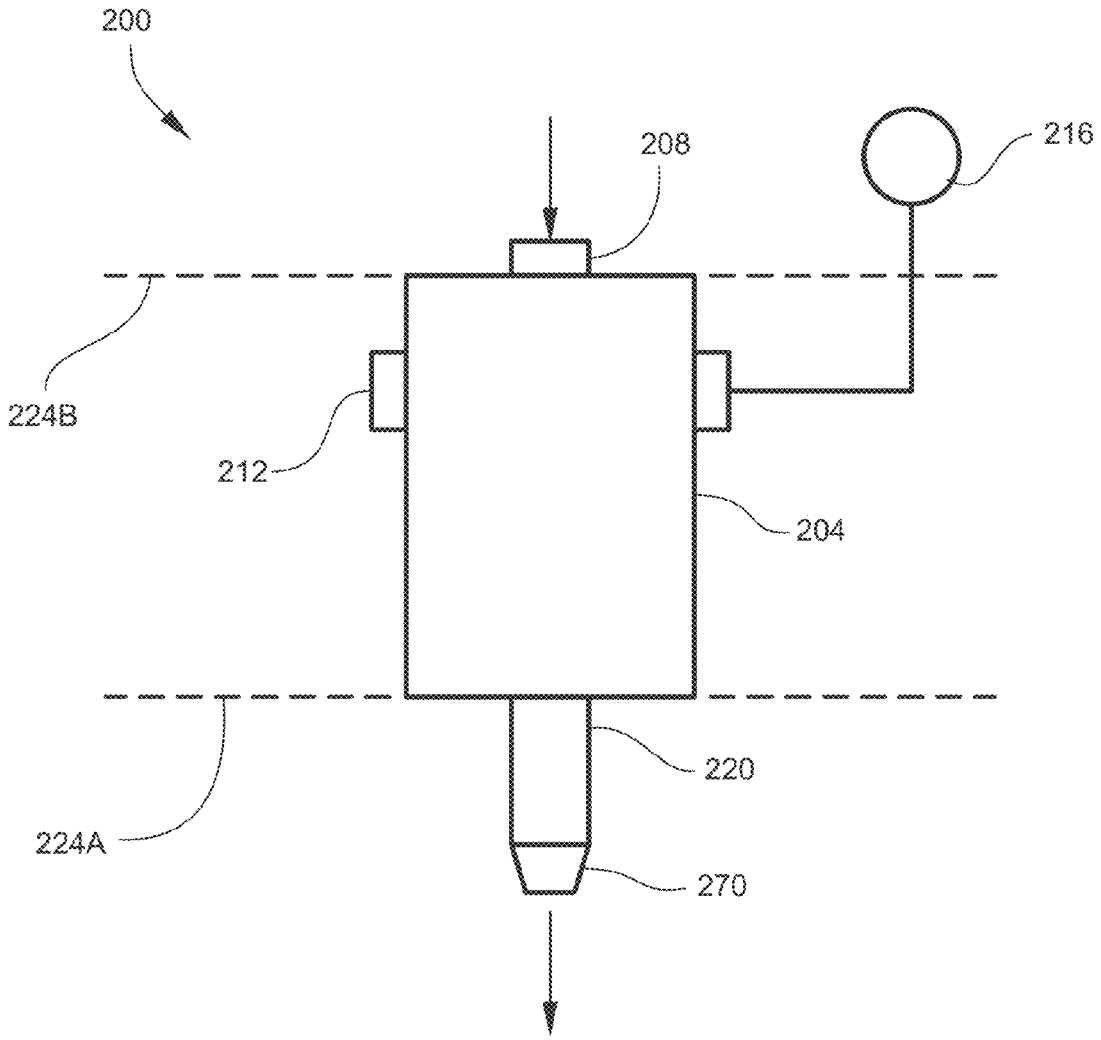
FIG. 2 is a schematic view of a plasma source (or plasma generator) according to some embodiments.

FIG. 2 is a schematic view of a plasma source 200 (or plasma generator) according to some embodiments. The plasma source 200 may include a plasma source housing 204 enclosing an interior in which plasma is generated, a plasma port 270 in fluid communication with the housing 204, a gas inlet 208 for admitting a plasma-forming gas into the housing 204, a plasma-generating element 212 positioned near, on, or in the housing 204 for electromagnetic coupling with the plasma-forming gas, and a power source 216 for providing power to the plasma-generating element 212. In embodiments utilizing air plasma, the gas inlet 208 may be open to the ambient. In other embodiments, the gas inlet 208 may communicate with a reservoir (not shown) supplying a desired type of plasma-forming gas via a conduit, as indicated by an arrow. Depending on the type of plasma source 200 employed and its operating principle, the plasma-generating element 212 may include, for example, a set of electrodes and/or magnets, a resonant structure or cavity, a microwave waveguide, etc. The power source 216 may be an RF, AC, or DC power source.

The plasma port 270 may be an orifice or a nozzle having a desired geometry (e.g., simple orifice, converging, diverging, converging-diverging, etc.). The plasma port 270 may be located at or proximal to an end of the housing 204. Alternatively, the plasma source 200 may include a conduit 220 between the housing and the plasma port 270. The conduit 220 may be straight, curved, or bent in a desired manner. In some embodiments, the length and/or orientation of the conduit 220 relative to the housing 204 may be adjustable.

FIG. 2 also illustrates two alternative positions of the housing 204 relative to a wall of a given chamber of the MS system 100 (FIGS. 1A and 1B) into which the plasma is directed. In some embodiments the chamber wall is positioned at 224A, in which case the housing 204 is located outside the chamber. In other embodiments the chamber wall is positioned at 224B, in which case the housing 204 is located (at least partially) inside the chamber. In either case, the plasma generated in the interior housing 204 may be an atmospheric-pressure plasma in some embodiments.

In other embodiments, the housing 204 may be configured more like a tube. For example, the housing 204 may have a length-to-diameter aspect ratio more similar to the conduit 220 depicted in FIG. 2. Such a tube-shaped housing may extend to and terminate at the plasma port 270, without there being a structural transition between a housing 204 and a conduit 220. In such embodiments, the gas flow through the tube-shaped housing may serve a more significant role in projecting as-generated plasma from the plasma port 270 and onto contaminated surfaces. The plasma-generating element 212 may be configured to surround the outside surface of the tube-shaped housing in a cylindrically symmetrical manner. As one example, the plasma-generating element 212 may be a microwave-driven coil helically wound around the tube-shaped housing, structurally similar to the coil of an inductively coupled plasma (ICP) source. As another example, the tube-shaped housing may be a dielectric material and the plasma-generating element 212 may be a cylindrical electrode wrapped around the tube-shaped housing. An AC voltage applied to the cylindrical electrode generates a dielectric barrier discharge (DBD) in the tube-shaped housing. In all such embodiments, the plasma created in the tube-shaped housing may extend beyond the excitation region and reach nearby contaminated surfaces for cleaning.

In other embodiments, as described above, the plasma source 200 may not include a housing 208 and associated plasma port 270. In this case, the plasma-generating element 212 may located as desired directly in a selected chamber without being enclosed by a structural envelope distinct from the chamber walls.

Figure 3A:
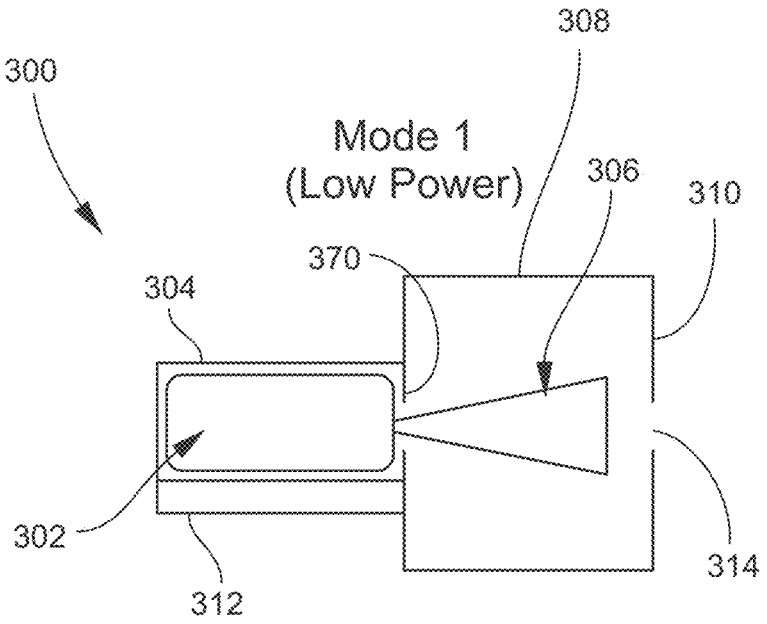
FIG. 3A is a schematic view of an example of a microwave plasma source illustrating operation in a low-power mode according to some embodiments.

FIG. 3A is a schematic view of an example of a microwave plasma source 300 according to some embodiments. The microwave plasma source 300 may include a plasma source housing 304 enclosing an interior in which plasma is generated, a plasma port 370 in fluid communication with the housing 304, a gas inlet (not shown) for admitting a plasma-forming gas into the housing 304, a plasma-generating element in the form of a microwave radiation source 312 positioned on the housing 304, and a microwave power source (not shown) for providing microwave (RF) power to the microwave radiation source 312. The microwave plasma source 300 may be a small device such as a microplasma chip or may be scaled larger. The microwave plasma source 300 is in fluid communication with a chamber 308 via the plasma port 370. In various embodiments, the chamber 308 may be larger (or substantially larger) than the housing 304 of the microwave plasma source 300. In various embodiments, the chamber 308 may be a chamber of an MS system. A wall 310 of the chamber 308 may include an opening 314. Depending on the embodiment, the opening 314 may serve to provide path for gas and/or ions to pass into an adjacent chamber. In some embodiments, a DC potential may be applied to the wall 310 such that the opening 314 and surrounding wall 310 function as an extraction lens or other type of electrode.

The microwave radiation source 312 may be any type suitable for use radiating microwave energy into the housing 304 to produce plasma, as appreciated by persons skilled in the art. Examples include, but are not limited to, resonators of planar geometry such as a split-ring resonator (SRR) and a coupled microstrip resonator (CMR) having a single resonating ring or concentric rings. Examples of SRR-based and CMR-based plasma generators are described in U.S. Pat. No. 8,736,174 and U.S. Patent Application Pub. No. US 2015/0015140, the entire contents of which are incorporated by reference herein.

In some embodiments, the microwave plasma source 300 is configured to operate in, and be switched between, a low-power mode and a high-power mode. FIG. 3A illustrates operation in the low-power mode. The microwave plasma source 300 actively generates and sustains plasma 302 in the plasma source housing 304 at relatively low microwave power, and emits a lower-density, colder plasma plume 306 into the chamber 308 via the plasma port 370. At low microwave power levels the microwave radiation, and thus the ionization required to sustain plasma, is confined (or substantially confined) to the plasma source housing 304. The resulting low-density plasma plume 306 may be insufficient for cleaning internal surfaces of the chamber 308. However, the plasma plume 306 may be effective for other purposes such as producing analyte ions from a sample, such as by flowing sample material into the chamber 308 and into contact with the plasma plume 306.

Figure 3B:
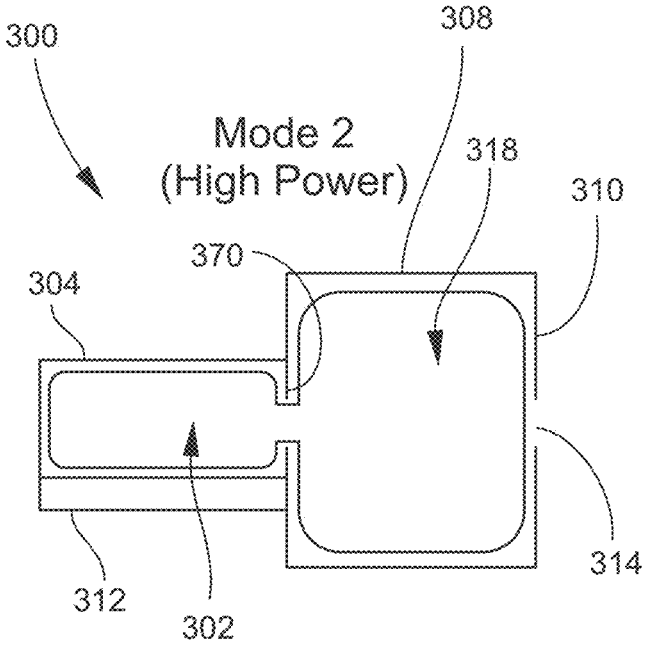
FIG. 3B is a schematic view of a microwave plasma source illustrating operation in a high-power mode or "projected plasma" mode according to some embodiments.

FIG. 3B is a schematic view of the microwave plasma source 300 illustrating operation in the high-power mode, or "projected plasma" mode. The high-power mode is based on an observed phenomenon in which at and above a certain microwave power threshold (or microwave power and gas pressure threshold), the amount of microwave power radiated away from the plasma source 300 and into the chamber 308 (e.g., outside of the plasma source housing 304) is sufficient to actively create and sustain high-density plasma 318 in the chamber 308. Without wishing to be bound by any specific theory, it is presently believed that at and above the threshold condition microwaves are able to propagate into the chamber 308 at least in part by surface wave propagation. This plasma 318 comprises a higher density of plasma species and the plasma species are at a higher temperature in comparison with the low-density, low-temperature plasma plume 306 described above. The high-density plasma 318 is actively energized in the chamber 308 and is effective for cleaning internal surfaces of the chamber 308 or contained in the chamber 308. By in effect projecting plasma 318 away from the plasma source 300, surfaces of MS instrumentation can be cleaned at a distance, so that microwave components can be kept out of regions containing analyte ions and communicate only through the plasma port 370.

Figure 4:
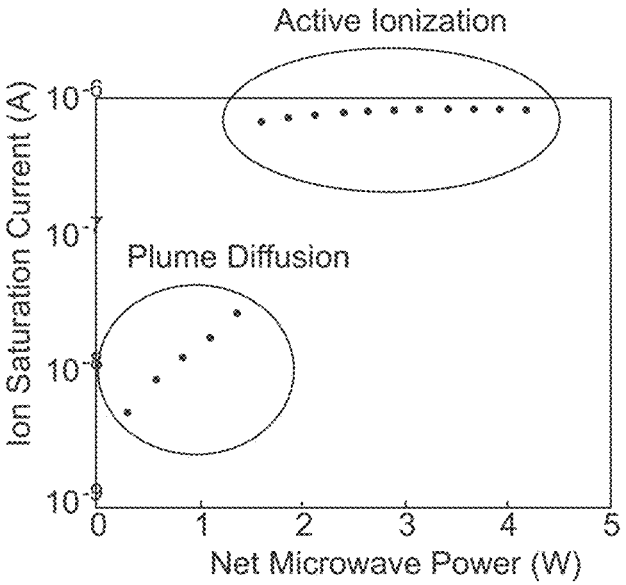
FIG. 4 is a plot of measured ion saturation current (in amperes) as a function of net microwave power (in watts) resulting from operating a microwave plasma source in a low-power mode and in a high-power mode.

FIG. 4 illustrates an example of the low-power mode the high-power mode, and the abrupt transition from one mode to the other. Specifically, FIG. 4 is a plot of measured ion saturation current (in amperes) as a function of net microwave power (in watts) using a current-collecting probe. The data in FIG. 4 were acquired by operating an instrument configured generally as described above and illustrated in FIGS. 3A and 3B. The microwave plasma source 300 generated argon microplasma, and the argon ion current was measured at the extraction lens (wall 310 with opening 314). The data points are grouped into two distinct regimes that may be referred to as a "plasma diffusion" regime 402 and an "active ionization" regime 404. The lower-current plasma diffusion regime 402 corresponds to the low-power mode, and the higher-current active ionization regime 404 corresponds to the high-power mode. The low-power mode (plasma diffusion regime 402) abruptly shifts to the high-power mode (active ionization regime 404) at a certain threshold power, in this example at about 1.5 W.

As noted above, the chamber 308 shown in FIGS. 3A and 3B may be a chamber of an MS system. For example, referring to FIGS. 1A and 1B, the chamber 308 may be the ionization chamber of the ion source 104, or a chamber associated with the mass analyzer 120, or one of the intermediate chambers 108, 112, and 116 between the ion source 104 and the mass analyzer 120. Thus, the microwave plasma source 300 shown in FIGS. 3A and 3B may be utilized as one or more of the plasma sources 170A, 170B, 170C, 170D, and 170E described above and shown in FIG. 1B. The above-described cleaning mode of the MS system 100 may entail operating one or more selected microwave plasma sources 300 in the high-power mode.

In embodiments where the chamber 308 is the ionization chamber of the ion source 104, the microwave plasma source 300 may be the device utilized to ionize sample material, by plasma-based ionization (photoionization, charge exchange, and/or electron impact). In such embodiments, the microwave plasma source 300 may be selectively operated in either an analytical mode or a cleaning mode (and switched between these modes) as noted above. In the analytical mode the microwave plasma source 300 is operated in the low-power mode, and the plasma plume 306 (FIG. 3A) diffusing into the chamber 308 ionizes sample material introduced in the chamber 308. In the cleaning mode the microwave plasma source 300 is operated in the high-power mode, and the highly energetic plasma 318 (FIG. 3B) actively maintained in the chamber 308 cleans internal surfaces of (or residing in) the chamber 308.

In other embodiments, the microwave plasma source 300 may be operated in a single or continuous self-cleaning analytical mode, or switched between a non-cleaning analytical mode and a self-cleaning analytical mode. In the self-cleaning analytical mode the microwave plasma source 300 is operated in the high-power mode, and the highly energetic plasma 318 (FIG. 3B) simultaneously produces analyte ions from sample material and cleans internal surfaces of the chamber 308. The self-cleaning analytical mode may be desirable for mitigating adsorption of eluting sample compounds to internal surfaces and reducing downtime between analytical experiments. In some applications, however, the self-cleaning analytical mode may be less desirable if it creates unwanted fragment ions or ions of no analytical value, which may require means for suppressing or removing such unwanted ions from the mass spectra produced by the MS system 100.

Figure 5:
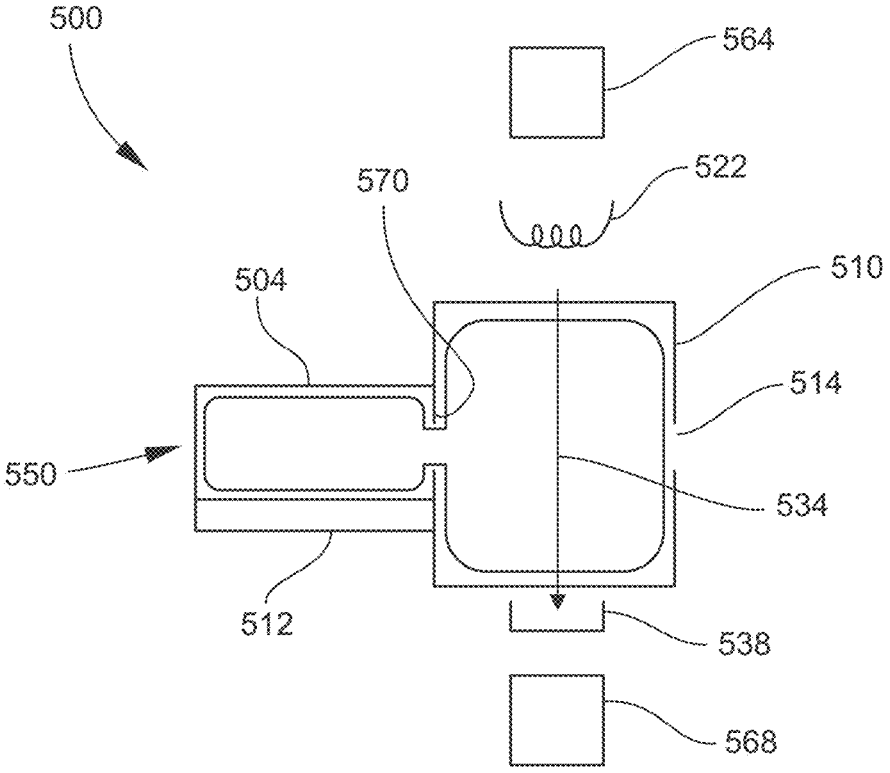
FIG. 5 is a schematic view of an example of an EI source that includes an integrated microwave plasma cleaning system according to some embodiments.

FIG. 5 is a schematic view of an example of an EI source 500 that includes an integrated plasma cleaning system according to some embodiments. The EI source 500 includes an ionization chamber 508, and electron source 522 for producing electrons, and one or more optics components for directing the as-produced electrons into an electron beam 534 through the ionization chamber 508. The electron source 522 is typically a thermionic cathode (typically in the form of a filament) composed of a material (e.g., tungsten, rhenium, tungsten-rhenium, etc.) capable of producing electrons by thermionic emission in response to being heated. Typically, heating is accomplished by running an electrical current through the thermionic cathode. Optics components for directing the electron beam 534 may include, for example, an electron trap 538 positioned as a counter-electrode across the from the electron source 522. The electron source 522 and the electron trap 538 may be positioned outside of the ionization chamber 508 and adjacent to openings through which the electron beam 534 passes. Magnets 564 and 568 (e.g., permanent magnets or electromagnets) may be positioned outside the ionization chamber 508 in an appropriate arrangement for applying a magnetic field with field lines oriented to focus the electron beam 534. A sample inlet (not shown) provides a path for sample material to flow into contact with the electron beam 534 to produce analyte ions by electron impact. A wall 510 of the ionization chamber 508 includes an opening (or ion exit) 514 that provides a gas conductance-limiting path for the as-produced analyte ions to travel into the next stage of the MS system. Ion optics components (e.g., extraction lens, focusing lens, etc.) may be positioned just outside the opening 514 to assist in drawing the analyte ions out from the ionization chamber 508 as a focused ion beam. In some embodiments, a DC potential may be applied to the wall 510 such that the opening 514 and surrounding wall 510 function as an extraction lens. An electrode known as a repeller (not shown) may be positioned in the ionization chamber 508 across from the opening 514 and electrically biased appropriately to assist in urging the as-produced analyte ions toward the opening 514. In some embodiments, the wall opposite to the wall 510 with the ion exit opening 514 may be biased to serve as the repeller.

The EI source 500 further includes a plasma source 550. The plasma source 550 may include a plasma source housing 504 enclosing an interior in which plasma is generated, a plasma port 570 providing fluid communication between the housing 504 and the ionization chamber 508, a gas inlet (not shown) for admitting a plasma-forming gas into the housing 504, a plasma-generating element 512 positioned on the housing 504, and a power source (not shown) for providing power to the plasma-generating element 512. Generally, the plasma source 550 may be any type of plasma source described herein. The plasma source 550 has been arbitrarily positioned in FIG. 5. The position of the plasma source 550 may be selected based on a number of factors such as, for example, the gas dynamics in the ionization chamber 508, the locations of internal surfaces to be cleaned, the orientations of magnetic and electric field lines in the ionization chamber 508, etc. The EI source 500 may be utilized as the ion source 104 shown in FIGS. 1A and 1B, with the plasma source 550 corresponding to the plasma source 170A shown in FIG. 1B.

Generally, the EI source 500 in conjunction with the plasma source 550 may be operated in a manner similar to other embodiments described herein. In some embodiments, the EI source 500 may be selectively operated in either an analytical mode or a cleaning mode, and switched between these modes as desired. In the analytical mode, the EI source 500 may be operated as a conventional EI source, producing analyte ions by generating the electron beam 534 without operating the plasma source 550. In the cleaning mode, the plasma source 550 may be operated to create plasma that diffuses into the ionization chamber 508 to clean internal surfaces therein. In some embodiments, the flow of sample material into the ionization chamber 508 is ceased during the cleaning mode, whereby the cleaning mode is distinct and separate from the analytical mode. However, the electron source 522 optionally may be operated during the cleaning mode to provide seed electrons for creating and sustaining plasma in the ionization chamber 508.

In some embodiments the plasma source 550 may be a microwave plasma source, in which case the plasma-generating element 512 may be a microwave radiation source configured according to any of the examples described herein. The high-power mode described above in conjunction with FIGS. 3A to 4 may be implemented during the cleaning mode to cause the microwave radiation to extend into the ionization chamber 508 and increase the effectiveness of the plasma as a cleaning agent.

In other embodiments, the EI source 500 may be operated in a single or continuous self-cleaning analytical mode. In this mode, the plasma source 550 is operated to actively generate plasma for cleaning internal surfaces while the electron source 522 generates electrons at the energy required for producing analyte ions from sample material. Alternatively, the EI source 500 may be switched between a non-cleaning analytical mode in which the plasma source 550 is not active and a self-cleaning analytical mode in which the plasma source 550 is active. As noted above, the self-cleaning analytical mode may be desirable for mitigating adsorption of eluting sample compounds to internal surfaces and reducing downtime between analytical experiments, but may not be desirable in applications where unwanted ions are created. For example, when plasma is generated to clean surfaces while sample material is being supplied to the ionization chamber 508, analyte ions may be generated from interaction of the sample with the plasma species, which are in addition to the analyte ions generated from interaction of the sample with the electron beam 534. This mixing of ionization mechanisms may be not desirable in some applications, and may require means for suppressing or removing such unwanted ions from the mass spectra produced by the MS system 100.

In some embodiments, the plasma utilized for in situ cleaning may be generated and sustained by a phenomenon known as electron cyclotron resonance (ECR). ECR can occur when a static magnetic field is present such that the frequency of electron gyration in the field is near the frequency of microwave electromagnetic fields propagating through the magnetic field. In this phenomenon there is a strong coupling of microwave energy into background electrons. Consequently, a plasma can then be formed very efficiently in what may be referred to as an ECR resonance zone, i.e., a region immersed in the static magnetic field and in which background electrons and gas molecules are present, and into which the microwave energy is directed. As in the case of the embodiment described above and illustrated in FIG. 5, the static magnetic field may be produced using either permanent magnets or electromagnets. The required field magnitude is directly and linearly proportional to the excitation frequency (e.g., approximately 875 G for the commonly used microwave frequency 2.45 GHz). If a magnetic field of the correct magnitude is present near a surface to be cleaned, a microwave ECR plasma can be formed in close proximity to this surface using microwave energy of the correct excitation frequency launched from a distance.

Figure 6:
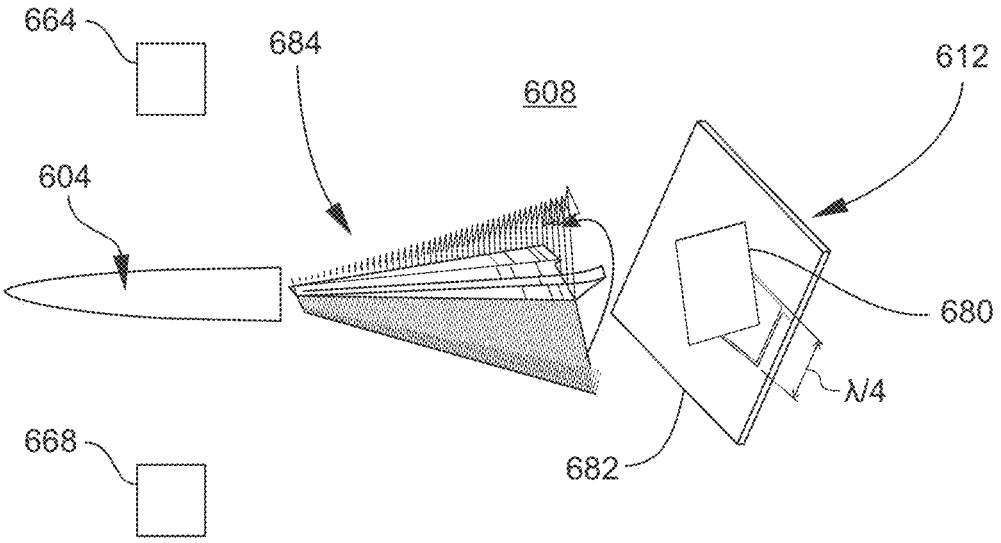
FIG. 6 is a schematic view of an example of a microwave ECR plasma source according to some embodiments.

Thus, in some embodiments the plasma source utilized to generate plasma for cleaning is a microwave ECR plasma source. FIG. 6 is a schematic view of an example of a microwave ECR plasma source 600 according to some embodiments. The microwave ECR plasma source 600 may include a microwave radiation source 612 (plasma-generating element) positioned on or in a chamber 608 containing one or more internal surfaces to be cleaned, a magnet assembly (e.g., magnets 664 and 668), a microwave power source (not shown) for providing microwave (RF) power to the microwave radiation source 612, and a gas inlet (not shown) for admitting a plasma-forming gas into the chamber 608. In some embodiments, the microwave ECR plasma source 600 may also include a suitable electron source (not shown) to provide seed electrons for plasma generation, such as a filament as described above in conjunction with FIG. 5. The various components of the microwave ECR plasma source 600 may be arranged relative to each other and to the internal surface(s) to be cleaned so as to establish an ECR resonance zone (or plasma interaction region, where microwave ECR plasma 604 is created) near such internal surface(s).

The magnet assembly may include any number of magnets 664 and 668, which have been arbitrarily located in FIG. 6 for schematic purposes. Generally, the magnets 664 and 668 are positioned as needed for orienting the magnetic field lines in the chamber 608 as desired. If the magnetic field lines pass into the surface to be cleaned, plasma electrons and ions will be guided along this field towards the surface. If the field lines are parallel to the surface, some plasma electrons and ions can still be incident on the surface, for example through cross-field diffusion. Other energetic species created (e.g., metastable atoms, ultraviolet photons) are not confined by the magnetic field and thus can diffuse to the surface to participate in cleaning independently of the magnetic field.

The microwave radiation source 612 may be any microwave antenna suitable for delivering microwave power into the ECR resonance zone. In some embodiments, the microwave antenna may be provided by the edges of a microstrip transmission line. As one non-limiting example, the microwave antenna may be a patch antenna formed by a metal patch or plate 680 mounted to a dielectric window 682. Microwave energy is most efficiently coupled into ECR plasma when the electromagnetic field is right-hand circularly polarized. A patch antenna is useful for generating right-hand circularly polarized electromagnetic fields in the far field of the antenna. This may be done by supplying power to the metal patch 680 through two legs (power feed lines) configured such that the power in one leg is 90 degrees out of phase (quarter-wavelength shift) with the power in the other leg.

In some embodiments, the microwave ECR plasma source 600 may be integrated with an EI source such as the EI source 500 described above and illustrated in FIG. 5, by adding the microwave radiation source 612 to the EI source 500. The magnets 564 and 568 often included with the EI source 500 may be utilized to provide the static magnetic field needed for creating an ECR resonance zone. Electrons emitted from the electron source 522 may be utilized as seed electrons for ECR plasma initiation. The microwave radiation source 612 may be selectively activated to switch the EI source 500 between an analytical mode and a cleaning mode (or a self-cleaning analytical mode).

Figure 7:
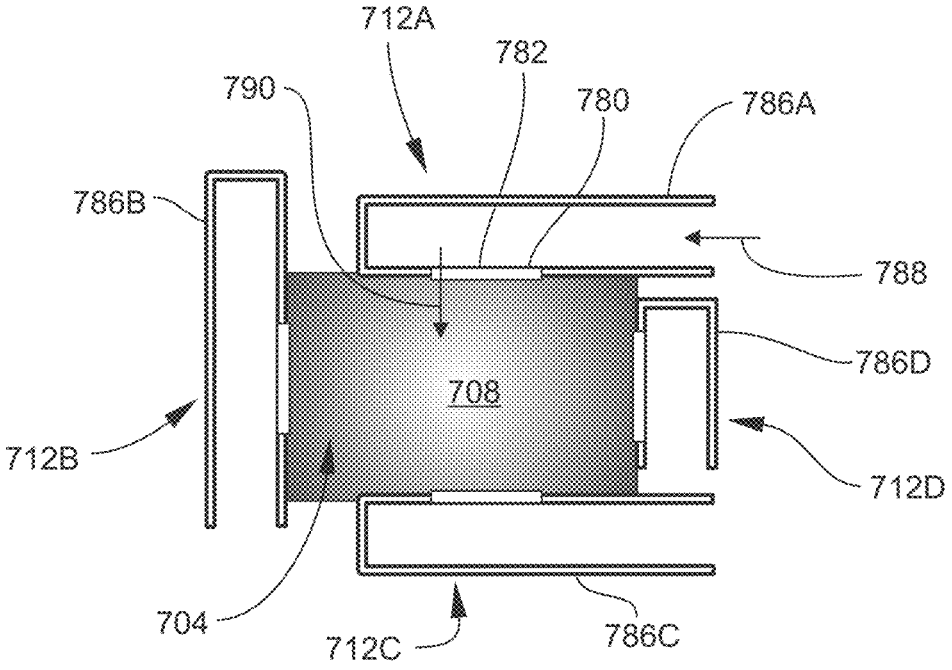
FIG. 7 is a schematic view of an example of a surface-wave microwave plasma source according to some embodiments.

FIG. 7 is a schematic view of an example of a surface-wave microwave plasma source 700 according to some embodiments. The surface-wave microwave plasma source 700 may include one or more microwave radiation sources 712A, 712B, 712C, and 712D (plasma-generating elements) positioned on (typically outside) a chamber 708 containing one or more internal surfaces to be cleaned, and one or more microwave waveguides 786A, 786B, 786C, and 786D for directing microwave energy 788 to the (one or more) microwave radiation sources 712A, 712B, 712C, and 712D. FIG. 7 illustrates four microwave radiation sources 712A, 712B, 712C, and 712D and corresponding waveguides 786A, 786B, 786C, and 786D, but more or less than four may be provided. In some embodiments, each microwave radiation source 712A, 712B, 712C, and 712D includes a slot antenna 780 (one or more slots formed through the wall of the corresponding waveguide 786A, 786B, 786C, and 786D) positioned on a corresponding vacuum window 782. Generally, the vacuum window 782 is a dielectric material that is integrally assembled with the wall of the chamber 708 in a fluid-tight manner so as to form (with the chamber wall) the boundary enclosing the interior of the chamber 708, and which is transparent to the microwave energy being supplied. One or more microwave power sources (not shown), such as for example magnetrons, generate the microwave energy 788 received by the waveguides 786A, 786B, 786C, and 786D. The slot antennas 780 radiate microwave energy 790 into the chamber 708 through the corresponding vacuum windows 782.

In the present embodiment, the microwave radiation sources 712A, 712B, 712C, and 712D excite surface waves through the slot antennas 780 that generate and sustain plasma 704 inside the chamber 708 along the boundaries of the corresponding vacuum windows 782. The plasma density in this case decreases in directions away from the vicinity of the slot antennas 780 (in proportion to the decrease in the electromagnetic field density), but the plasma 704 diffuses throughout the chamber 708. By this configuration, the entire (or a substantial portion of) chamber 708 can be filled with plasma 704 instead of being localized to a small region. Hence, the surface-wave microwave plasma source 700 may be desirable for cleaning larger surfaces or surface areas at different locations of the chamber 708. Depending on the size and internal features of the chamber 708, a single waveguide and corresponding microwave radiation source may be effective. However, the use of a plurality of waveguide-fed slot antennas 780 as surface wave plasma excitation sources at different locations along the chamber walls (as in the illustrated embodiment) may be desirable for making the plasma distribution through the chamber 708 more uniform. Particles in this global plasma may then available throughout the mass spectrometry instrument, and may be accelerated onto contaminated surfaces to clean them by, for example, electrically biasing these surfaces as described herein. Moreover, the microwave instrumentation in this case is outside the vacuum manifold and communicates with its interior entirely through the vacuum window(s) 782, and thus does not disturb the mass spectrometry instrument when plasma is not being excited.

Figure 8:
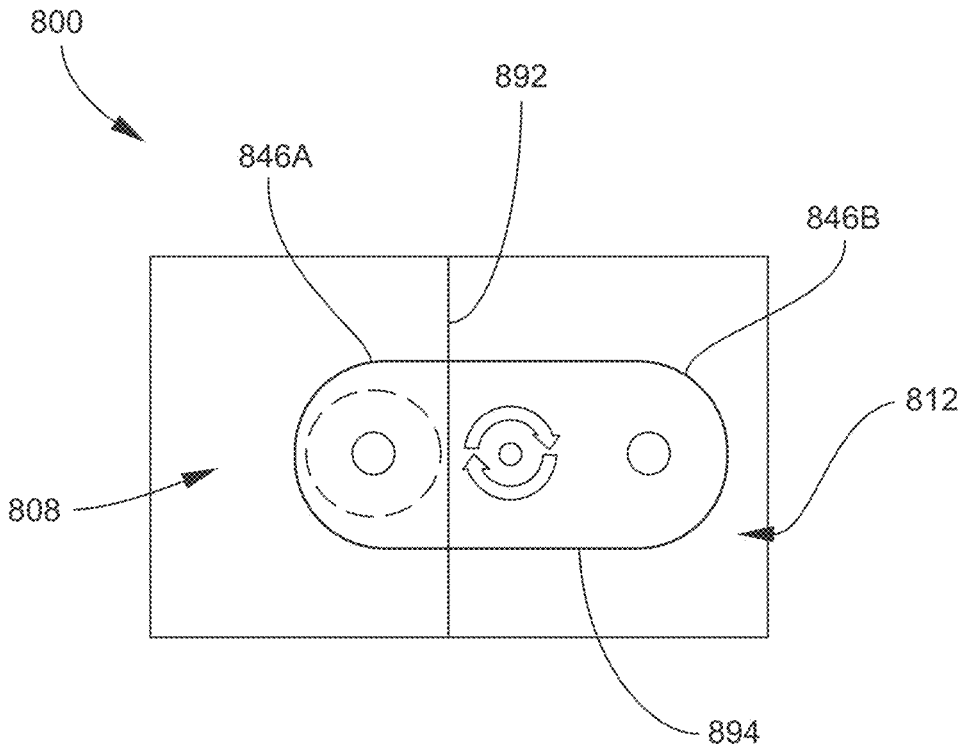
FIG. 8 is a schematic view of an example of a plasma cleaning system integrated with an MS system according to other embodiments.

FIG. 8 is a schematic view of an example of a plasma cleaning system 800 integrated with an MS system according to other embodiments. The plasma cleaning system 800 includes a plasma cleaning chamber (or second chamber) 812 adjacent to an analytical chamber (or first chamber) 808 of the MS system. The "analytical" chamber 808 may be any chamber of the MS system in which ion processing (ion production, ion guiding, mass filtering, ion fragmentation, ion beam cooling, ion beam shaping, ion detection, etc.) occurs during the normal course of analyzing a sample. The analytical chamber 808 includes at least one internal surface 846A to be cleaned. For example, the internal surface 846A may be any of the various ion optics devices described herein such as an ion lens component. A wall 892 provides a physical boundary between the analytical chamber 808 and the plasma cleaning chamber 812, whereby the analytical chamber 808 and the plasma cleaning chamber 812 may both be parts of the vacuum manifold of the MS system but may be held at different pressures if desired. For example, any of the chambers shown in FIGS. 1A and 1B (the ionization chamber of the ion source 104, a chamber associated with the mass analyzer 120, or one of the intermediate chambers 108, 112, and 116 between the ion source 104 and the mass analyzer 120) may be partitioned into an analytical chamber 808 and a plasma cleaning chamber 812. Stated differently, the analytical chamber 808 and the plasma cleaning chamber 812 may be considered as being two distinct, independently pressure-controllable regions of a single chamber. Alternatively, the analytical chamber 808 may be considered as corresponding to any of the chambers shown in FIGS. 1A and 1B, with the plasma cleaning chamber 812 being positioned adjacent to such chamber.

The plasma cleaning system 800 may include any of the plasma sources (not shown) described herein for generating plasma for cleaning purposes. In the present embodiment, such plasma is generated and/or flowed in the plasma cleaning chamber 812 only and not in the analytical chamber 808. That is, the plasma flow path is confined to the plasma cleaning chamber 812 and does not extend into the analytical chamber 808. Thus, the plasma source(s) of the present embodiment may be located near, on, or in the plasma cleaning chamber 812. The plasma cleaning system 800 further includes a movement device (or adjustment device) 894 configured for moving the internal surface 846A alternately into and out from the plasma flow path. The movement device 894 may be configured for moving the internal surface 846A by rotation about an axis as illustrated and/or by linear translation along one or more axes. The movement device 894 may be a stage or platform to which the internal surface 846A is mounted or with which the internal surface 846A is integrated. The movement device 894 may be driven by automated means (e.g., motor-driven), and may operate in response to input from a user or a computing device/system controller of the MS system. When the internal surface 846A is moved into the plasma flow path (i.e., is exposed to plasma in the plasma cleaning chamber 812), the plasma is able to remove contaminants from the internal surface by reaction between the contaminants and one or more types of active species of the plasma as described herein. Contaminants so removed may then be entrained in the plasma/gas flow and removed from the plasma cleaning chamber 812 via a vacuum port (not shown) of the plasma cleaning chamber 812.

The movement device 894 may be configured for moving the internal surface 846A alternately into and out from the plasma cleaning chamber 812. Thus, the movement device 894 may move the internal surface 846A between the plasma cleaning chamber 812 and a location external to the plasma cleaning chamber 812. In the illustrated embodiment, the movement device 894 moves or shifts the internal surface 846A alternately between the plasma cleaning chamber 812 and the analytical chamber 808. During an analytical mode of operation, the internal surface 846A is positioned in the analytical chamber 808. In a case where the internal surface 846A is an ion optics component, the internal surface 846A is at a normal operating position in the analytical chamber 808 at which the internal surface 846A performs its normal ion optics-related function (e.g., beam focusing, ion acceleration, etc.). The MS system (or that part of the MS system shown in FIG. 8) may be switched from the analytical mode to a cleaning mode of operation. During the switching step, the movement device 894 moves the internal surface 846A from the analytical chamber 808 into the plasma cleaning chamber 812. The internal surface 846A may be moved through a gas conductance-limiting opening (not shown) of the wall 892, which opening is small enough to enable the analytical chamber 808 and the plasma cleaning chamber 812 to be maintained at different pressures. During the cleaning mode of operation, the internal surface 846A is positioned in the plasma cleaning chamber 812 and in contact with plasma therein.

As further illustrated in FIG. 8, a plurality of internal surfaces may be mounted to (or integrated with) the movement device 894. FIG. 8 shows a first internal surface 846A and a second internal surface 846B with the understanding that more than two internal surfaces may be provided. The internal surfaces 846A and 846B may be the same components and thus substitutes for each other. The movement device 894 may be configured such that only one internal surface is located in the analytical chamber 808 (and in the operative position) at any given time, while all other internal surfaces provided with the movement device 894 are located in the plasma cleaning chamber 812. For example, FIG. 8 shows the first internal surface 846A in the analytical chamber 808 and the second internal surface 846B in the plasma cleaning chamber 812. By this configuration, the first internal surface 846A may be operated in the normal manner to process analyte ions while, at the same time, the plasma cleaning system 800 is operated to actively clean the second internal surface 846B. Hence, in this embodiment the MS system may be operated in the analytical mode and the cleaning mode simultaneously. Once the second internal surface 846B has been sufficiently cleaned, or once the first internal surface 846A has been sufficiently fouled to warrant cleaning, the movement device 894 may be operated to switch the positions of the second internal surface 846B and the first internal surface 846A, whereby the second internal surface 846B is then operated to carry out the normal ion processing function in the analytical chamber 808 while the first internal surface 846A is being cleaned in the plasma cleaning chamber 812.

It is thus evident that in the present embodiment, the cleaning mode may be implemented without breaking vacuum or requiring internal surfaces to be removed from the MS system. Consequently, the cleaning mode may be implemented with minimal downtime or disturbance to the normal sample analyzing operation of the MS system. The cleaning mode in this embodiment may be considered as an online cleaning mode. Moreover, the use of the separate plasma cleaning chamber 812 is effective for keeping the analytical chamber 808 isolated from plasma utilized for cleaning surfaces. This is beneficial in applications, for example, in which the presence of a cleaning plasma in an active analyte ion beam path might cause unwanted fragmentation or ionization of the analyte ions. In addition, because the plasma cleaning chamber 812 is separate from the analytical chamber 808, the plasma cleaning chamber 812 may be operated at a higher pressure than the analytical chamber 808, which in some cases can be more conducive to plasma cleaning.

In any of the foregoing embodiments, to maintain a higher density of plasma throughout a chamber of the MS system, a periodic array of permanent magnets may be affixed to the walls of the chamber such that their direction of magnetization is perpendicular to the chamber wall, with successive magnets having alternating polarity. This arrangement forms a series of magnetic cusps that form so-called "magnetic mirrors," which reflect charged plasma particles away from the chamber wall, thus confining the plasma and reducing particle loss at the chamber walls. The magnetic fields in such an arrangement are localized to the wall thereby not disrupting mass spectrometry instrumentation in the central region of the vacuum manifold.

Figure 9:
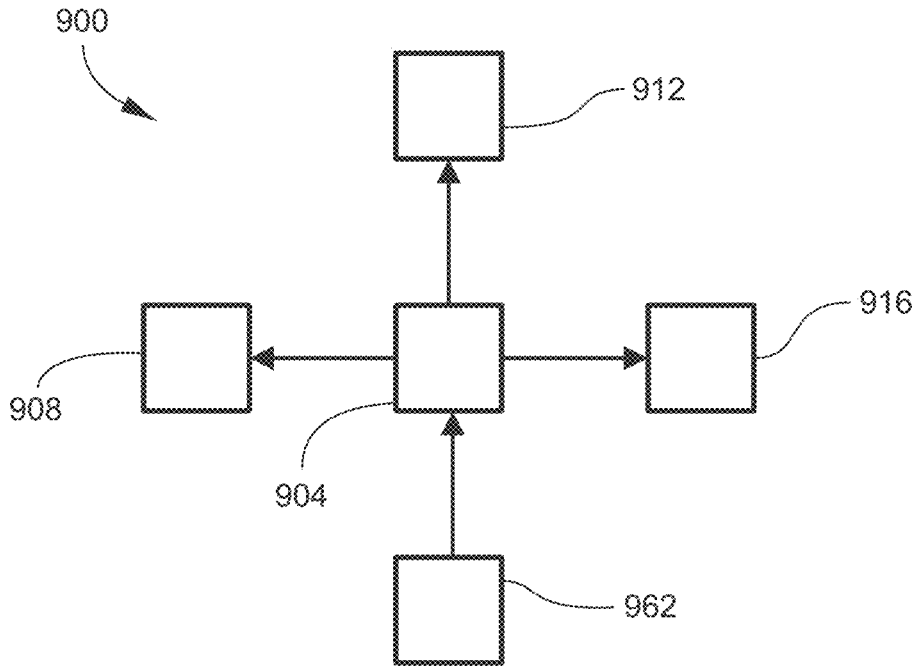
FIG. 9 is a schematic view of an example of a control system of an MS system according to some embodiments.

FIG. 9 is a schematic view of an example of a control system 900 of an MS system, such as the MS system 100 generally described above and illustrated in FIGS. 1A and 1B, according to some embodiments. The control system 900 may be configured for, among other functions, switching the operation of the MS system 100 between an analytical mode and a cleaning mode according to any of the embodiments described above. The control system 900 may include a system controller 904 such as a computing device. The controller 904 may control (via signal communication, for example) an analytical system 908, a vacuum system 912, and a plasma cleaning system 916 of the MS system 100. The analytical system 908 schematically represents a set of components operated during the analytical mode, such as the ion source 104, the MS 120, and various ion optics such as described above in conjunction with FIG. 1A. The vacuum system 912 schematically represents components utilized for controlling the vacuum levels in the various chambers included with the MS system 100, such as pumps communicating with the vacuum ports 124, 126, 128, 130, and 132 (FIGS. 1A and 1B). The plasma cleaning system 916 schematically represents the plasma source(s) provided in the MS system 100, such as any of the plasma sources described above and illustrated in FIGS. 2 to 8, including any other components involved in the generation and control of plasma.

In the analytical mode, the controller 904 controls the operation of the components of the analytical system 908 as needed for ionizing a sample, analyzing the sample, and producing analytical data (e.g., mass spectra, chromatograms, etc.), as appreciated by persons skilled in the art. In the analytical mode, the controller 904 controls the vacuum system 912 as needed for maintaining the pressures in the various chambers at the vacuum levels required for the analytical mode. During the analytical mode, the plasma source(s) (and other components associated with the plasma cleaning system 916) may or may not be active, depending on the embodiment and as described herein. In embodiments where the cleaning mode is operated offline, the controller 904 may cease the operation of various components of the analytical system 908 during the cleaning mode and initiate operation of the plasma cleaning system 916. However, some components of the analytical system 908 may continue to operate during an offline or non-analytical cleaning mode. For example, sample material may continue to flow in the MS system 100 but may not be ionized and/or may not be analyzed, i.e., during the cleaning mode the analytical data may not be produced or may be disregarded (e.g., ignored, removed from the analytical data, etc.). In other embodiments that provide a self-cleaning analytical mode, an online cleaning mode, and/or a tandem (simultaneous) analytical mode and cleaning mode, the controller 904 may control the operations of the components of the analytical system 908 and the plasma cleaning system 916 as needed. In the cleaning mode, the controller 904 controls the vacuum system 912 as needed for maintaining the pressures in the various chambers at the vacuum levels required for the cleaning mode, which in some embodiments may be higher pressures as described above.

As also shown in FIG. 9, the controller 904 receives ion measurement signals (ion detector signals) from an ion detector 962 of the MS system 100 (e.g., ion detector 162 in FIGS. 1A and 1B). The controller 904 processes these signals as needed for generating analytical data (e.g., mass spectra, chromatograms, etc.). After running the MS system 100 in the analytical mode, a user may determine that the MS system 100 should be switched to run in the cleaning mode. This determination may be based on information provided by the analytical data (or the ion measurement signals utilized to produce the analytical data). For example, an observed degradation in the ion measurement signal or spectral or chromatographic data, such as intensity (e.g., overall intensity, or intensity of one or more specific m/z values), resolution, etc., may lead to a determination that the MS system 100 should be switched to run in the cleaning mode. In some embodiments, the controller 904 may be configured for analyzing the analytical data to assist with making, or automatically making, a determination that the MS system 100 should be switched to run in the cleaning mode. For example, the controller 904 may compare an attribute of the ion measurement signal (e.g., intensity) or of the spectral data (e.g., resolution) with a threshold value. Based on this comparison, the controller 904 may be configured to cease the analytical mode, or further to switch to the cleaning mode. Alternatively, the controller 904 may be configured to output an indication to the user that the user should investigate whether the MS system 100 should be run in the cleaning mode.

Alternatively or additionally, the MS system 100 may be operated to produce analytical data from ionized species produced during the cleaning mode. In this case, a determination may be made (by the user or the controller 904) as to whether to switch from operating in the cleaning mode to operating in the analytical mode (or to simply cease operating in the cleaning mode) based on the analytical data produced during the cleaning mode. Moreover, this determination may be based on a comparison of the analytical data produced during the cleaning mode to the analytical data produced during the analytical mode. Depending on the embodiment, the ionized species produced during the cleaning mode may include plasma species, species derived from the material removed from the internal surface(s) as a result of the plasma cleaning process, and/or analyte ions produced from the sample (residual sample material in the MS system 100, or sample material that is continually introduced into the MS system 100 during the cleaning mode).

For any of the foregoing functions or purposes, the controller 904 may include hardware, firmware, and/or software as appreciated by persons skilled in the art. The controller 904 may be configured to perform or control all or part of one or more steps of any of the methods disclosed herein. The controller 904 may be configured to carry out control operations similar to those described in U.S. Pat. No. 8,378,293, the entire content of which is incorporated by reference herein.

Exemplary Embodiments

Exemplary embodiments provided in accordance with the presently disclosed subject matter include, but are not limited to, the following:

1. A method for cleaning a mass spectrometry (MS) system, the method comprising: operating the MS system in an analytical mode by introducing a sample into the MS system, producing analyte ions from the sample, and producing analytical data from the analyte ions; switching between operating the MS system in the analytical mode and a cleaning mode; and during the cleaning mode: generating plasma by operating a plasma source of the MS system; and contacting an internal surface of the MS system with the plasma to clean the internal surface.

2. The method of embodiment 1, wherein: the internal surface is in a chamber of the MS system; the plasma source comprises a microwave radiation source, a plasma outlet, and a housing communicating with the chamber via the plasma outlet; and generating plasma comprises operating the plasma source at a microwave power sufficient to generate plasma both in the housing and in the chamber.

3. The method of embodiment 2, wherein the housing and the microwave radiation source are positioned external to the chamber.

4. The method of embodiment 1, wherein: the internal surface is in a chamber of the MS system; the plasma source comprises a plasma outlet and a housing communicating with the chamber via the plasma outlet; and during the analytical mode, operating the plasma source at a low microwave power sufficient to generate plasma in the housing, wherein the plasma flows into the chamber via the plasma outlet; and during the cleaning mode, operating the plasma source at a high microwave power sufficient to generate plasma both in the housing and in the chamber.

5. The method of embodiment 4, wherein introducing the sample comprises contacting the sample with the plasma to produce analyte ions from the sample.

6. The method of any of embodiments 1 to 5, comprising, during the cleaning mode, either ceasing introducing the sample into the ionization chamber or continuing to introduce the sample into the ionization chamber.

7. The method of any of embodiments 1 to 5, comprising, during the analytical mode, generating plasma and contacting the sample with the plasma to produce analyte ions from the sample.

8. The method of any of embodiments 1 to 5, comprising: switching between operating the MS system in the analytical mode and the cleaning mode a plurality of times, such that a plurality of analytical mode iterations and a plurality of cleaning mode iterations are performed; and during each cleaning mode iteration, contacting the sample with the plasma to produce analyte ions from the sample.

9. The method of embodiment 8, comprising a step selected from the group consisting of: diverting the analyte ions produced during each cleaning mode iteration to avoid producing analytical data during each cleaning mode iteration; disregarding analytical data produced from the analyte ions produced during each cleaning mode iteration; and comparing analytical data produced from the analyte ions produced during each cleaning mode iteration to analytical data produced from the analyte ions produced during each analytical mode iteration.

10. The method of embodiment 8 or 9, comprising: during each analytical mode iteration, generating plasma at a low energy input and contacting the sample with the plasma to produce analyte ions from the sample; and during each cleaning mode iteration, generating plasma at a high energy input.

11. The method of embodiment 8 or 9, comprising: during each analytical mode iteration, generating plasma, contacting the sample with the plasma to produce analyte ions from the sample, and applying a low-voltage bias to the internal surface effective for guiding the analyte ions; and during each cleaning mode iteration, applying a high-voltage bias to the internal surface effective for accelerating charged particles of the plasma into contact with the internal surface.

12. The method of any of the preceding embodiments, comprising, before contacting the internal surface, moving the internal surface into proximity with the plasma.

13. The method of embodiment 12, wherein moving the internal surface into proximity with the plasma is done while switching from the analytical mode to the cleaning mode.

14. The method of embodiment 13, comprising, after contacting the internal surface with the plasma, switching from the cleaning mode to the analytical mode by moving the internal surface away from the plasma.

15. The method of any of embodiments 12 to 14, wherein the internal surface is in a chamber of the MS system, and moving the internal surface into proximity with the plasma is done without substantially changing a gas pressure in the chamber.

16. The method of any of embodiments 12 to 15, wherein the internal surface is in a chamber of the MS system, and moving the internal surface comprises moving the internal surface into the chamber from a location external to the chamber.

17. The method of embodiment 16, wherein the location external to the chamber is another chamber of the MS system, and moving the internal surface comprises moving the internal surface through an opening between the chambers.

18. The method of any of embodiments 12 to 17, comprising, before moving the internal surface into proximity with the plasma, operating the internal surface to process analyte ions.

19. The method of any of embodiments 12 to 18, wherein the internal surface is a first internal surface, and further comprising: after contacting the first internal surface with the plasma, moving a second internal surface into proximity with the plasma; and contacting the second internal surface with the plasma to clean the second internal surface.

20. The method of embodiment 19, comprising, after contacting the first internal surface with the plasma, moving the first internal surface from the chamber to a location external to the chamber.

21. The method of any of embodiments 1 to 20, wherein generating plasma comprises flowing a plasma-forming gas to a plasma generation region proximate to the internal surface, applying a static magnetic field to the plasma generation region, and directing microwave energy to the plasma generation region, wherein the static magnetic field has a strength and the microwave energy has a frequency effective for generating the plasma in the plasma generation region by electron cyclotron resonance (ECR) excitation.

22. The method of embodiment 21, wherein directing microwave energy comprises operating a microwave radiation source positioned at or near the internal surface.

23. The method of embodiment 22, wherein the microwave radiation source is configured for generating a right-hand circularly polarized electric field in the plasma generation region.

24. The method of embodiment 22 or 23, wherein the microwave radiation source comprises a patch antenna.

25. The method of any of embodiments 21 to 24, wherein generating plasma comprises directing electrons to the plasma generation region.

26. The method of embodiment 1, wherein the internal surface is in an ionization chamber of an electron ionization (EI) source, and producing analyte ions from the sample comprises contacting the sample with electrons produced by the EI source during the analytical mode.

27. The method of embodiment 26, comprising operating the EI source to produce electrons for generating the plasma during the cleaning mode.

28. The method of embodiment 26 or 27, comprising: during the analytical mode, introducing the sample into the ionization chamber; and during the cleaning mode, either ceasing introducing the sample into the ionization chamber or continuing to introduce the sample into the ionization chamber.

29. The method of any of embodiments 1 to 20, wherein the internal surface is in a chamber of the MS system, and generating plasma comprises flowing a plasma-forming gas in the chamber, and radiating microwave energy into the chamber from a slot antenna external to the chamber.

30. The method of embodiment 29, wherein the plasma is generated in the chamber by surface-wave excitation.

31. The method of embodiment 29 or 30, wherein generating plasma comprises radiating microwave energy into the chamber from a plurality of slot antennas spaced from each other at different positions external to the chamber.

32. The method of any of the preceding embodiments, wherein the internal surface is in a chamber of the MS system, and further comprising applying a magnetic field near an inside surface of the chamber to reflect charged species of the plasma away from the inside surface.

33. The method of any of the preceding embodiments, comprising applying a magnetic field, an electric field, or both a magnetic field and an electric field, to the plasma to guide the plasma.

34. The method of embodiment 33, comprising applying the magnetic field, the electric field, or both the magnetic field and the electric field, with a field strength and field orientation effective for accelerating charged particles of the plasma into contact with the internal surface.

35. The method of any of the preceding embodiments, comprising alternately applying a low-voltage bias and a high-voltage bias to the internal surface, wherein the low-voltage bias is effective for guiding the analyte ions, and the high-voltage bias is effective for accelerating charged particles of the plasma into contact with the internal surface.

36. The method of any of the preceding embodiments, wherein the internal surface is a surface of one or more electrodes of a multipole ion guide, and further comprising: during the analytical mode, operating the multipole ion guide to apply an electric field effective for guiding the analyte ions through the multipole ion guide; and during the cleaning mode, operating the multipole ion guide to apply an electric field effective for accelerating charged particles of the plasma into contact with the internal surface.

37. The method of any of the preceding embodiments, wherein contacting the internal surface with the plasma is selected from the group consisting of: generating the plasma proximate to the internal surface; generating the plasma at a location effective to enable the plasma to diffuse to the internal surface; flowing the plasma into contact with the internal surface; and a combination of two or more of the foregoing.

38. The method of any of the preceding embodiments, wherein contacting the internal surface with the plasma removes material from the internal surface, and further comprising flowing the removed material into a vacuum port of the MS system.

39. The method of any of the preceding embodiments, comprising generating the plasma from a plasma-forming gas selected from the group consisting of: ambient air; an oxygen-containing gas; diatomic oxygen gas; a hydrogen-containing gas; diatomic hydrogen gas; a noble gas; helium-containing gas; helium; a halogen-containing gas; a fluorine-containing gas; and a combination of two or more of the foregoing.

40. The method of any of the preceding embodiments, wherein the plasma is a non-thermal plasma.

41. The method of any of the preceding embodiments, comprising generating the plasma at about atmospheric pressure in a housing separate from the chamber.

42. The method of any of the preceding embodiments, wherein the plasma source comprises a plasma outlet and a housing communicating with the chamber via the plasma outlet, the housing is positioned inside the chamber or outside the chamber, and contacting the internal surface with the plasma comprises flowing the plasma from the housing into the chamber.

43. The method of any of the preceding embodiments, comprising determining whether to switch from operating in the analytical mode to operating in the cleaning mode based on the analytical data.

44. The method of any of the preceding embodiments, comprising producing analytical data from ionized species produced during the cleaning mode, and determining whether to switch from operating in the cleaning mode to operating in the analytical mode based on the analytical data produced during the cleaning mode.

45. The method of embodiment 44, wherein determining whether to switch from operating in the cleaning mode to operating in the analytical mode is based on comparing the analytical data produced during the cleaning mode to the analytical data produced during the analytical mode.

46. A mass spectrometry (MS) system configured for performing the method of any of the preceding embodiments.

47. The MS system of embodiment 46, comprising: an ion source configured for producing the analyte ions; a mass analyzer; a chamber in which the internal surface is located; and a controller configured for switching between operating the MS system in the analytical mode and a cleaning mode, wherein: the chamber is selected from the group consisting of: a chamber located at the ion source; a chamber located at the mass analyzer; and a chamber located between the ion source and the mass analyzer; and the plasma source is configured for generating or flowing plasma in the chamber.

48. A mass spectrometry (MS) system, comprising: an ion source configured for producing analyte ions; a mass analyzer configured for receiving analyte ions from the ion source; an ion detector configured for receiving analyte ions from the mass analyzer and outputting ion measurement signals; a chamber selected from the group consisting of: a chamber located at the ion source; a chamber located at the mass analyzer; and a chamber located between the ion source and the mass analyzer; an internal surface located in the chamber; a plasma source configured for generating or flowing plasma in the chamber effective for cleaning the internal surface; and a controller configured for switching between operating the MS system in an analytical mode and a cleaning mode, wherein: during the analytical mode, the controller is configured for producing analytical data from the ion measurement signals; and during the cleaning mode the controller is configured for operating the plasma source to generate or flow the plasma in the chamber.

49. The MS system of embodiment 47 or 48, wherein the plasma source is configured for producing the analyte ions in the ion source.

50. The MS system of embodiment 49, wherein the plasma source is configured for generating plasma in pulses comprising alternating on and off states of the plasma or alternating high-energy and low-energy states of the plasma.

51. The MS system of embodiment 49 or 50, wherein the controller is configured for: during the analytical mode, applying a low-voltage bias to the internal surface effective for guiding the analyte ions; and during the cleaning mode, applying a high-voltage bias to the internal surface effective for accelerating charged particles of the plasma into contact with the internal surface.

52. The MS system of any of embodiments 47 to 51, wherein the plasma source comprises a plasma outlet and a housing communicating with the chamber via the plasma outlet, and the housing is positioned inside the chamber or outside the chamber.

53. The MS system of embodiment 52, wherein the plasma source is configured for applying a microwave power sufficient to generate plasma both in the housing and in the chamber.

54. The MS system of any of embodiments 47 to 53, comprising a movement device configured for moving the internal surface toward and away from the chamber.

55. The MS system of embodiment 54, wherein: the chamber comprises a first chamber and a second chamber; the plasma source is configured for generating or flowing plasma in the second chamber; and the movement device is configured for moving the internal surface from the first chamber to the second chamber while switching to the cleaning mode.

56. The MS system of embodiment 55, wherein the internal surface is a first internal surface, and further comprising a second internal surface, wherein: the movement device is configured for moving the first internal surface from the first chamber to the second chamber, and moving the second internal surface from the second chamber to the first chamber, such that the first internal surface is subjected to plasma cleaning while the second internal surface is operated to process analyte ions; and the movement device is configured for moving the first internal surface from the second chamber to the first chamber, and moving the second internal surface from the first chamber to the second chamber, such that the second internal surface is subjected to plasma cleaning while the first internal surface is operated to process analyte ions.

57. The MS system of any of embodiments 47 to 56, comprising a magnet configured for applying a static magnetic field to a plasma generation region proximate to the internal surface, and a microwave radiation source configured for directing microwave energy to the plasma generation region.

58. The MS system of embodiment 57, wherein the magnet and the microwave radiation source are configured for operating at parameters effective for generating plasma in the plasma generation region by electron cyclotron resonance (ECR) excitation.

59. The MS system of embodiment 57 or 58, wherein the microwave radiation source comprises a patch antenna or a device configured for generating a right-hand circularly polarized electric field in the plasma generation region.

60. The MS system of any of embodiments 57 to 59, comprising an electron source configured for directing electrons to the plasma generation region.

61. The MS system of any of embodiments 47 to 60, wherein the ion source is an electron ionization (EI) source, the chamber is located at the EI source, and the EI source is configured for producing or directing electrons in the chamber.

62. The MS system of any of embodiments 47 to 61, comprising a plasma guide device configured for guiding charged particles of the plasma in the chamber, wherein the plasma guide device comprises a magnet, an electrode, or both a magnet and an electrode.

63. The MS system of embodiment 62, wherein the plasma guide device is configured for applying a magnetic field, an electric field, or both a magnetic field and an electric field, with a field strength and field orientation effective for accelerating charged particles of the plasma into contact with the internal surface.

64. The MS system of any of embodiments 47 to 56 or 61 to 63, wherein the plasma source comprises a slot antenna configured for directing microwave radiation into the chamber.

65. The MS system of embodiment 64, wherein the plasma source is configured for generating plasma in the chamber by surface-wave excitation.

66. The MS system of any of embodiments 47 65, comprising a magnet configured for applying a static magnetic field near an inside surface of the chamber effective for reflecting charged species of the plasma away from the inside surface.

67. The MS system of any of embodiments 47 to 66, wherein the controller is configured for determining whether to switch between operating in the analytical mode and in the cleaning mode based on analytical data produced during the analytical mode, during the cleaning mode, or during both the analytical mode and the cleaning mode.

68. The MS system of embodiment 47 to 67, wherein the internal surface is selected from the group consisting of: a wall of the chamber; an ion optics component; an electrode; an ion guide electrode; a skimmer; a gas conductance barrier; an ion detector; an ion slicer; an ion pulser; and ion mirror; and a combination of two or more of the foregoing.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the controller 904 schematically depicted in FIG. 9. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the controller 904 in FIG. 9), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A mass spectrometry (MS) system, comprising:

an ion source configured for producing analyte ions;

a chamber;

an internal surface located in the chamber;

a plasma source configured for generating or flowing plasma in the chamber effective for cleaning the internal surface, the plasma source comprising a microwave power source, a plasma outlet, and a housing communicating with the chamber via the plasma outlet, wherein the plasma source is configured for applying a microwave power sufficient to generate plasma both in the housing and in the chamber; and a controller configured for switching between operating the MS system in an analytical mode and a cleaning mode, wherein:

during the analytical mode, the controller is configured for producing analytical data from the ion measurement signals; and during the cleaning mode the controller is configured for operating the plasma source to generate or flow the plasma in the chamber.

2. The MS system of claim 1, wherein the plasma source is configured for generating plasma in pulses comprising alternating on and off states of the plasma or alternating high-energy and low-energy states of the plasma.

3. A mass spectrometry (MS) system, comprising:

an ion source configured for producing analyte ions;

a chamber;

an internal surface located in the chamber;

a plasma source configured for generating or flowing plasma in the chamber effective for cleaning the internal surface;

a plasma guide device configured for guiding charged particles of the plasma in the chamber, wherein the plasma guide device comprises a magnet, an electrode, or both a magnet and an electrode; and a controller configured for switching between operating the MS system in an analytical mode and a cleaning mode, wherein:

during the analytical mode, the controller is configured for producing analytical data from the ion measurement signals; and during the cleaning mode the controller is configured for operating the plasma source to generate or flow the plasma in the chamber.

4. The MS system of claim 1, comprising a magnet configured for applying a static magnetic field to a plasma generation region proximate to the internal surface, and a microwave radiation source configured for directing microwave energy to the plasma generation region.

5. The MS system of claim 4, wherein the magnet and the microwave radiation source are configured for operating at parameters effective for generating plasma in the plasma generation region by electron cyclotron resonance (ECR) excitation.

6. The MS system of claim 4, wherein the microwave radiation source comprises a patch antenna or a device configured for generating a right-hand circularly polarized electric field in the plasma generation region.

7. The MS system of claim 1, wherein the plasma source comprises a slot antenna configured for directing microwave radiation into the chamber.

8. The MS system of claim 1, wherein the controller is configured for determining whether to switch between operating in the analytical mode and in the cleaning mode based on analytical data produced during the analytical mode, during the cleaning mode, or during both the analytical mode and the cleaning mode.

9. The MS system of claim 1, wherein the controller is configured for:

during the analytical mode, operating the plasma source at a low microwave power sufficient to generate plasma in the housing, wherein the plasma flows into the chamber via the plasma outlet; and during the cleaning mode, operating the plasma source at a high microwave power sufficient to generate plasma both in the housing and in the chamber.

10. A mass spectrometry (MS) system, comprising:

an ion source configured for producing analyte ions;

a chamber;

an internal surface located in the chamber;

a movement device configured for moving the internal surface toward and away from the chamber;

a plasma source configured for generating or flowing plasma in the chamber effective for cleaning the internal surface; and a controller configured for switching between operating the MS system in an analytical mode and a cleaning mode, wherein:

during the analytical mode, the controller is configured for producing analytical data from the ion measurement signals; and during the cleaning mode the controller is configured for operating the plasma source to generate or flow the plasma in the chamber.

11. The MS system of claim 10, wherein:

the chamber comprises a first chamber and a second chamber;

the plasma source is configured for generating or flowing plasma in the second chamber; and the movement device is configured for moving the internal surface from the first chamber to the second chamber while switching to the cleaning mode.

12. The MS system of claim 11, wherein the internal surface is a first internal surface, and further comprising a second internal surface, wherein:

the movement device is configured for moving the first internal surface from the first chamber to the second chamber, and moving the second internal surface from the second chamber to the first chamber, such that the first internal surface is subjected to plasma cleaning while the second internal surface is operated to process analyte ions; and the movement device is configured for moving the first internal surface from the second chamber to the first chamber, and moving the second internal surface from the first chamber to the second chamber, such that the second internal surface is subjected to plasma cleaning while the first internal surface is operated to process analyte ions.

13. The MS system of claim 10, wherein the controller is configured for moving the internal surface into proximity with the plasma.

14. The MS system of claim 13, wherein the controller is configured for, before moving the internal surface into proximity with the plasma, operating the internal surface to process analyte ions.

15. The MS system of claim 3, wherein the controller is configured for:

during the analytical mode, applying a low-voltage bias to the internal surface effective for guiding the analyte ions; and during the cleaning mode, applying a high-voltage bias to the internal surface effective for accelerating charged particles of the plasma into contact with the internal surface.

16. The MS system of claim 3, wherein the plasma guide device is configured for applying a magnetic field, an electric field, or both a magnetic field and an electric field, with a field strength and field orientation effective for accelerating charged particles of the plasma into contact with the internal surface.

17. The MS system of claim 3, comprising an additional magnet configured for applying a static magnetic field near an inside surface of the chamber effective for reflecting charged species of the plasma away from the inside surface.

* * * * *